US005083604A

United States Patent [19]

Zeze et al.

[11] Patent Number: 5,083,604

[45] Date of Patent: Jan. 28, 1992

[54] METHOD FOR IMPROVING INTERNAL CENTER SEGREGATION AND CENTER POROSITY OF CONTINUOUSLY CAST STRAND

[75] Inventors: Masafumi Zeze; Hideyuki Misumi; Tokinari Shirai; Takashi Nishihara, all of Oita, Japan

[73] Assignee: Nippon Steel Corporation, Tokyo, Japan

[21] Appl. No.: 700,546

[22] Filed: May 15, 1991

Related U.S. Application Data

[63] Continuation of Ser. No. 391,183, Aug. 8, 1989.

[30] Foreign Application Priority Data

Aug. 8, 1988 [JP] Japan ..... 63-198369

[51] Int. Cl.[5] ..... B22D 11/12

[52] U.S. Cl. ..... 164/476; 164/417

[58] Field of Search ..... 164/476, 417

[56] References Cited

FOREIGN PATENT DOCUMENTS 0219803 4/1987 European Pat. Off. .

OTHER PUBLICATIONS

I&SM, Jun. 1989, pp. 34 to 39, "Development of Technology To Eliminate Centerline Segregation In Continuously Cast Slabs", M. Hattori et al.

1988 Steelmaking Conference Proceedings, pp. 78 to 85, "Production of Induced Cracking (HIC) Resistant Steel by CC Soft Reduction", M. Yamada et al.

*Primary Examiner*—Kuang Y. Lin

*Attorney, Agent, or Firm*—Kenyon & Kenyon

[57] ABSTRACT

A method for improving the internal center segregation and center porosity of a continuously cast slab, wherein an unsolidified side edge portion and a given area at the upstream side of the cast slab during continuous casting are defined as a plane reducing zone; a holding means is provided having two sets of top and bottom walking plane reducing compressing means at the plane reducing zone, front and rear supporting shafts common to the sets, eccentric cams for each set arranged at the front and the rear supporting shafts for holding and releasing of the cast slab, and a front and a rear displacement mechanism; the cast slab holding position of the upper surface of the bottom side walking plane reducing means of each set is set within 0.5 mm of the deviation on a passline of a continuous casting machine; the cast slab holding position of the lower surface of the top walking plane reducing means of each set is set at a desired reduction taper having a plane reduction ratio of 0.5 to 5.0% in accordance with an amount of solidified shrinkage of an unsolidified cast slab in a longitudinal compressing plane reducing zone and an amount of the heat shrinkage of the solidified shell; said eccentric cam set and the front and the rear displacement mechanisms are driven to operate the holding, moving forward, opening, and moving backward alternately thereby compressively carrying the cast slab; wherein the improvement comprises the steps of measuring, for each the two sets of plane reducing means the holding distance of the cast slab at before and after the top and the bottom walking plane reducing means, obtaining reduction taper from the measured holding distances and predetermined distances of distance measured positions before and after the top and the bottom walking plane reducing means, obtaining the difference between the reduction taper, then controlling positions of the front and the rear supporting shafts so that each set of walking plane reducing means is given to the desired reduction taper when the obtained difference is 0.1 mm/m or less, and bringing the walking plane reducing means having the measured reduction taper least different from the desired reduction taper close to the other measured reduction taper by changing the plane reduction ratio within a range of 0.5 to 5.0% by controlling the amount of rotation for releasing the holding of the eccentric cams, when the difference is more than 0.1 mm/m and the reduction taper are all less than said desired reduction taper.

4 Claims, 12 Drawing Sheets

(List continued on next page.)

OTHER PUBLICATIONS

Nippon Kokan Technical Report No. 121, 1988, pp. 1 to 8, "Improvement of Centerline Segregation . . . ", T. Kitagawa et al.

Tetsu-to-Hagane, vol. 71, No. 4, Mar. 1985, S213, "Theoretical Analysis of the Fluid Flow in the Mushy Zone of CC Slab", by K. Miyazawa et al.

Tetsu-to-Hagane, vol. 71, No. 4, Mar. 1985, S212, "Effect of Soft Reduction on the Formation of V-Segregation . . . ", M. Zeze et al.

Tetsu-to-Hagane, vol. 71, No. 4, Sep. 1986, S1091, "Soft Reduction Efficiency of the Strand Near the Crater End", M. Hiyashida et al.

Transactions ISIJ, vol. 24, No. 11, Nov. 1984, pp. 883 to 890, "New Evaluation Techniques of Segregation in Continuously Cast Steel", K. Miyamura et al.

※ χo : LEVEL WHICH HOLDING SURFACE
(UPPER BAR : UNDER SURFACE ; LOWER BAR : TOP SURFACE)
PLANE REDUCES AND HOLDS LAST STRAND SLAB SURFACE
(TOP SURFACE , UNDER SURFACE)

METHOD FOR IMPROVING INTERNAL CENTER SEGREGATION AND CENTER POROSITY OF CONTINUOUSLY CAST STRAND

This is a continuation of application Ser. No. 07/391,183 filed Aug. 8, 1989, now abandoned.

BACKGROUND OF THE INVENTION

1. Field of the Invention

The present invention relates to a method for improving the internal center segregation and center porosity of a continuously cast strand, particularly a slab.

2. Description of the Related Art

Techniques for producing continuously cast strands, for example, slabs booms, and billets, etc. are disclosed in three publications, i.e., Japanese Unexamined Patent Publication (Kokai) Nos. 62-89555 and 62-259647 and Japanese Examined Patent Publication (Kokoku) No. 63-5904. These references disclose a method and a device for preventing the generation of internal center segregation and center porosity. These references disclose the use of two sets of opposing inner and outer walking bars to compress the surface portions of the slab having unsolidified molten metal in the interior. The top face of the lower bars is aligned with the bottom side of the cast strand slab so as to coincide with the lower side pass line of the continuous casting machine, and the top face of the lower bars contact the bottom side of the cast strand. The bottom face of the upper bars contact the top side of the cast strand to provide a selected compression gradient or plane reduction taper. The inclination or reduction ratio given the top bars is based on the compression gradient or reduction taper, converted to unit length, needed to prevent solidification shrinkage motion or flow, thermal shrinkage, and bulging motion or flow from causing internal center segregation and center porosity. This is determined in accordance with the amount of solidification shrinkage and the amount of thermal shrinkage of the solidified shell. The solidified shell of the unsolidified end portion of the cast strand is alternately compressed or plane reduced by each set of walking bars across the width of the cast strand. As a result, motion of impurity-enriched molten steel toward the unsolidified end portion of the cast strand, and solidification of the impurity-enriched molten steel at the unsolidified end portion are sought to be prevented. The expansion of the unsolidified end portion and gap formation are also sought to be prevented. The above-mentioned device and method do indeed, at times, alleviate the problems of the end center segregation and center porosity generated at a cast strand slab width center portion. The improvement is not uniformly achieved and the quality of the produced material may vary in the width direction.

The present inventors found by experiments that the reasons for such non-uniform quality in the width direction is an imbalance in compression (plane reduction) between the walking bars.

The walking bars are designed to give uniform compression. However, imbalances in actual practice are mainly generated due to the following reasons.

1) Temperature deviation across the width direction of the cast slab due, e.g., to non-uniform cooling.

2) There can be different degrees of solidification across the width of the portion of the slab being compressed. E.g., the degree of solidification at the center may be significantly different than the degree of solidification at the edges as one passes across the width of the portion of the slab being compressed. The walking bars at the edge portions may be pressing against a completely solidified thickness.

3) Non-uniform shape of the strand slab due to bulging and other irregularities caused by the rolls located in front of the walking bars can have an influence.

4) The present inventors found that center segregation and center porosity are improved by the following: balance of the compression gradients (reduction tapers) of the top walking bars in the longitudinal direction of the cast strand slab; balanced compression of the upper surfaces of the bottom walking bars; control of the deviation of the actual passline of the cast strand slab in comparison to the passline of the continuous casting machine; balance between the reaction forces derived from the top and bottom slab surfaces under compression. In the present specification, compression has the same meaning as plane reduction.

SUMMARY OF THE INVENTION

It is an object of the present invention to provide a method for improving the internal center segregation and center porosity in a continuously cast strand slab.

The following terms are used in this specification.

The plane reducing zone is the area of the cast slab which is held between the upper and lower walking bars. This is illustrated in FIG. 9. As can be seen in FIG. 9, the unsolidified end portion of the slab falls within the plane reducing zone.

The reduction ratio, with reference to FIG. 15, is determined by the formula:

$$(t_1-t_2)/t_1=\Delta t/t$$

wherein $t_1$ is the thickness of the slab prior to reduction and $t_2$ is the thickness of the slab after reduction.

The reduction taper, with reference to FIG. 15 is determined by the formula:

$$(D_1-D_2)/D=D/D$$

wherein:

$D_1$ is the holding distance at the rear side of the plane reducing zone;

$D_2$ is the holding distance at the forward side of the plane reducing zone; and D is a predetermined longitudinal distance between the points of measurement of $D_1$ and $D_2$.

The holding distances $D_1$, $D_2$ may be measured by sensors such as 17, 18 of FIG. 8 and the distance D is the longitudinal distance between sensors in the casting direction.

In one embodiment of the present invention, there is provided a method for improving internal center segregation and center porosity of a continuously cast slab cast from a continuous casting machine having a passline. A plane reducing zone is defined from a solidified portion downstream from an unsolidified end portion of the slab (FIG. 9) to a selected slab portion upstream from the unsolidified end portion during upstream from the unsolidified end portion during continuous casting of the slab.

A slab reducing means for the slab is provided at the plane reducing zone. The slab reducing means has a group of top and a group of bottom walking bars. Both the top group and bottom group of walking bars is composed of a set of outer bars and a set of inner bars disposed between the outer bars, thus defining a walking plane reducing means.

The slab reducing means carries out an upward and downward movement of the inner and outer walking bars of each set of walking bars to hold, reduce, and release the slab.

The slab reducing means comprises front and rear support shafts common to said sets, eccentric cams for each set arranged on the support shafts, wheel bearings arranged about the eccentric cams, and a rotating mechanism means for rotating the eccentric cams.

The slab reducing means further includes forward direction and rearward direction displacement mechanism means for forward and rearward displacement of the sets of top and bottom walking bars.

Each set of inner and outer bottom walking bars has an upper surface for holding the cast slab, with the upper surfaces of a respective set of bottom walking bars being positioned within a 0.5 mm deviation from the continuous casting machine passline when the cast slab is being reduced and held by such set of bars.

Each set of the inner and outer top walking bars has a lower surface for holding the cast slab. The lower surface of the top walking bars is set at a selected with the amount of solidified shrinkage of the unsolidified slab and heat shrinkage of the solidified shell in the plane reducing zone. The reduction taper is within a plane reduction ratio of 0.5 to 5.0% when the reduction taper is converted into plane reduction ratio.

The slab reducing means, including the forward direction and rearward direction displacement mechanism means, operates to hold, move forward, release, and move rearward each set of the inner and outer walking bars to thereby alternately compressively carry the cast slab.

In a first embodiment of the present invention, the improvement comprises:

Measuring for each of two opposed sets of walking bars after the start of holding and before release, holding distances $D_1$ and $D_2$ on the slab for the top and bottom walking bars, wherein $D_1$ and $D_2$ correspond to the thickness of the slab at a spaced apart longitudinal distance D, and obtaining the reduction taper of the top walking bars by the formula $(D_1-D_2)/D$.

The differences between the reduction tapers of each set of top walking bars is compared. When the difference between the reduction tapers is 0.1 mm/m or less, each set of the top walking bars is reduced by the slab reducing means to obtain the predetermined reduction taper after obtaining differences between the measured reduction tapers and the predetermined reduction taper.

When the differences of the reduction tapers are more than 0.1 mm/m and each of the reduction tapers of the top walking bars is less than the predetermined reduction taper, the set of top walking bars having a smaller different distance from the predetermined reduction taper is positioned by the slab reducing means to obtain the reduction taper of the other set of top walking bars. After agreement of the reduction tapers of both inner and outer top walking bars, both the inner and the outer sets of top walking bars are reduced by the slab reducing means to the predetermined reduction taper.

In a second embodiment of the present invention, the improvement comprises:

Measuring the plane reaction force at the front end and rear end of each set of top and bottom walking bars caused by holding of the cast slab by the walking bars at a selected rotary angle of the eccentric cams and obtaining a first ratio between the measured values of the plane reducing reaction forces at the front end and rear end of each inner set and outer set of the walking bars.

A second ratio is obtained from the first ratio and a predetermined ratio of the plane reducing reaction forces for each set of the walking bars. The plane reducing reaction forces are controlled while holding the cast slab by the slab reducing means so that the second ratio is from 0.9 to 1.1.

BRIEF DESCRIPTION OF DRAWINGS

FIG. 7 illustrates a side elevation view, FIG. 8 illustrates a front view, FIG. 9 illustrates a cross-sectional view illustrating the motion of double-eccentric cams when the outer walking bars are pressed down for holding, FIG. 10 is a perspective view, and FIG. 11 is a system diagram of a control device for the apparatus;

DESCRIPTION OF THE PREFERRED EMBODIMENTS

Figure 1:
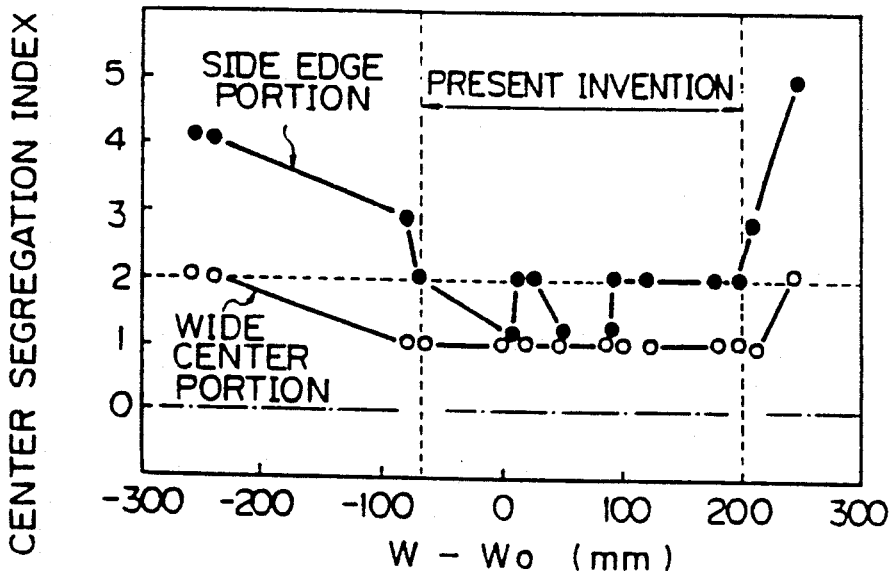
FIG. 1 is a graph of the relationship between the center segregation index and $W-W_0$ (mm) wherein W is width of the unsolidified end portion of strand slab, and $W_0$ is the compression width of surface compressing sections.

The preferred embodiments will now be explained with reference to the drawings.

The technical conditions and reasons necessary for carrying out the present invention are as follows.

1) Conditions And Reasons For Apparatus.

The working position of the walking bars for compressing and gripping an unsolidified portion of a cast strand slab in the plane reducing zone is set to the same desired position for all sets of walking bars in the longitudinal direction of the plane reducing zone. Thus, the distribution of the compression force in the longitudinal direction of the cast strand slab can be maintained equal between sets of walking bars compared to a conventional apparatus in which the position where the compression force acts is continuously alternately moved with a predetermined stroke. If the area of the walking bars brought into contact with the cast strand slab is made the same for all sets of the walking bars, or if the compression force is controlled in accordance with the area difference between the sets, the product of the total contact area of the walking bars and the pressure can be made equal. This enables a uniform transmission of an equal compression force to the walking bars throughout the entire length of the strand being cast. This ensures that the cast strand is equally compressed by different sets of walking bars.

2) Temperature Conditions Of The Unsolidified End Portion And Reasons Therefor

The surface temperature of the cast strand between the unsolidified end portion (FIG. 9) containing unsolidified steel and a given upstream portion closer to the mold is kept at 600° C. to 900° C. for a time duration that ranges from a period in which the steel shell becomes rigid enough to ensure uniform surface tension (approximately 1 minute) to a period in which the cast strand reaches a point where effective recuperation may no longer be achieved following the completion of solidification in the surrounding gripping surfaces (approximately 7 minutes). These measures assure the rigidity of the solidifying shell held by the slab reducing means and assure uniform distribution of surface tension across the shell. Consequently, uniform distribution of compression force and uniform compression are achieved with greater ease. At the same time, the amount of bulging is reduced to 0.05 mm maximum and the motion of unsolidified steel due to bulging is substantially completely prevented.

3) Conditions For Compressing The Unsolidified End Portion By Multiple Steps With Slab Reducing Means And Reasons Therefor By supporting a portion of the cast slab strand from a leading end portion containing unsolidified steel (referred to as an unsolidified end portion) to at least 1 to 4.5 m upstream from the unsolidified end portion, bulging is prevented. At the same time, when the cast slab is intermittently and by multiple steps compressed by the surfaces of the walking bar sets for a suitable compression time and the slab is completely solidified within the zone gripped by the surfaces of the walking bar sets, a solidification structure is achieved wherein macrosegregation or spot segregation can be remarkably improved.

That is, when the cast strand slab is compressed intermittently and at multiple steps, small or low pressure compression is repeated. The same effect as that of a single strong compression can be obtained. Thus, a small compression apparatus and a small force are sufficient to give a required amount of compression.

Generally, the more steps of compression in the range of a constant solidification ratio and the longer the compressing time, the greater the effect of the reduction of the maximum deforming stress. Actually, the deformation increases along with the increase of the solidification. There is a critical value with respect to the length of the comprssion time. Further, since the solidification of the cast strand slab progresses during a limited time period, the number of compression steps is dependent on the compression time period. Thus, the compression conditions must be determined taking into account this relationship.

The gripping or holding conditions used in the present invention are characteristic of the scope of the above-mentioned Japanese Unexamined Patent Publication (Kokai) No. 62-259647, which corresponds to European Patent Publication No. 0 219 803. Namely, as previously discussed, during the holding of the cast strand slab, the surface temperature of the cast strand is maintained at 600° to 900° C. Compression force is applied to each set of walking bars which are dynamically equal.

Figure 14:
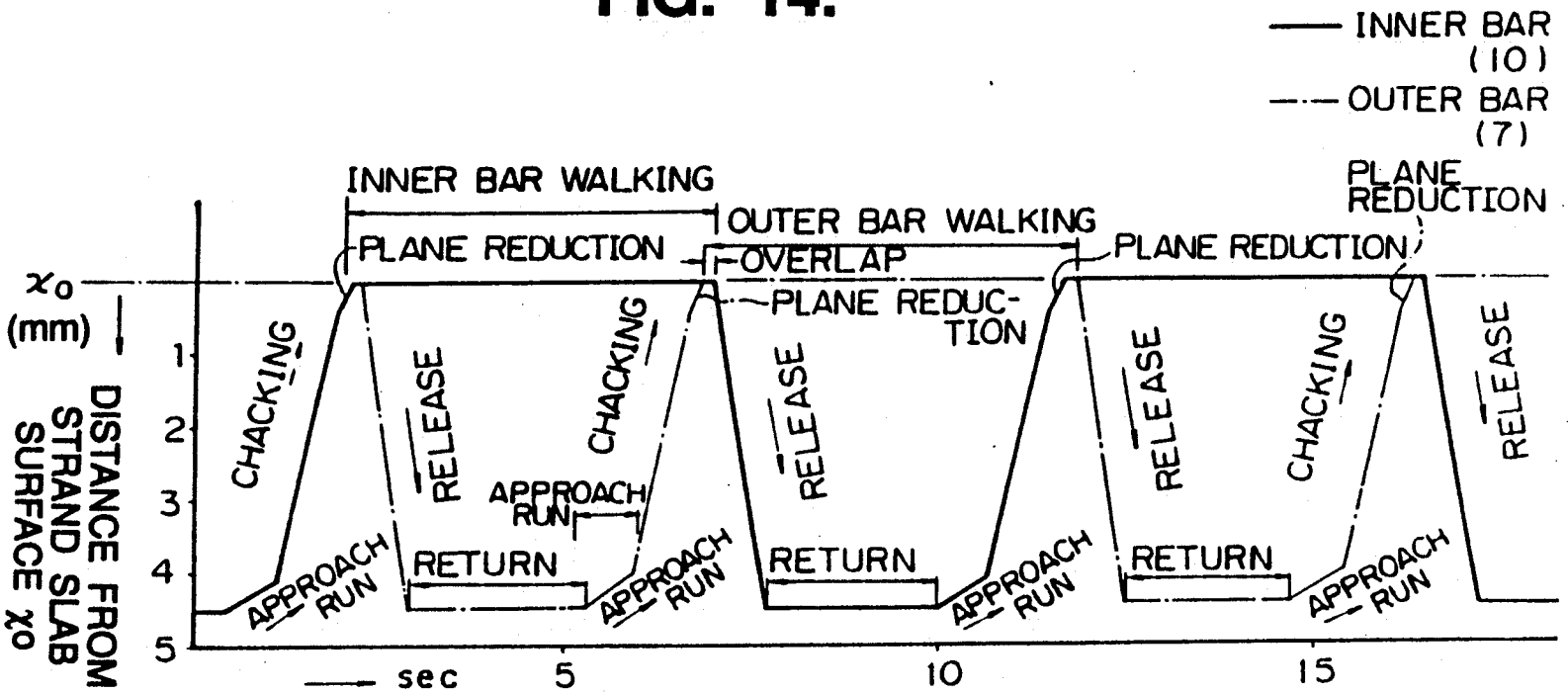
FIG. 14 is a diagram of relationship between the distance of the walking bars from the slab surface $x_0$ and time (sec)
Figure 15:
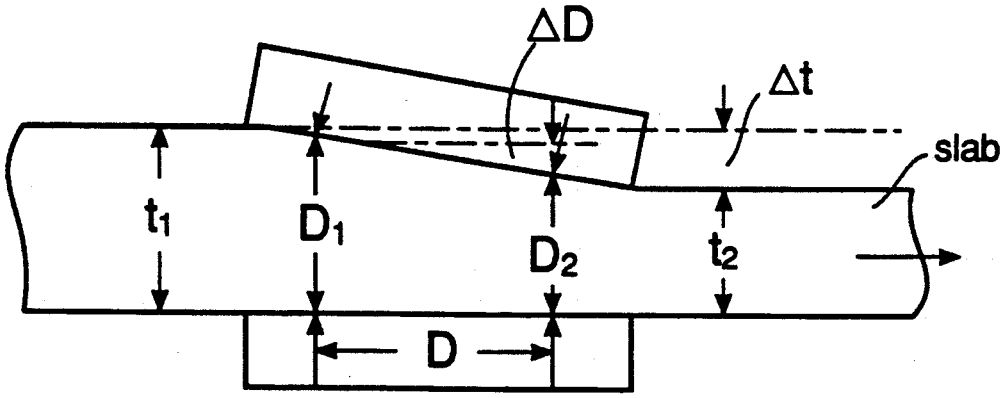
FIG. 15 illustrates the reduction ratio and reduction taper.

An illustrative time cycle for chucking, gripping, releasing, and return of the walking bars is illustrated in FIG. 14.

4) Range Of The Strand Slab Width Direction Where The Unsolidified End Portion Of Strand Slab Is Compressed When an unsolidified end portion of a strand slab is compressed in the width direction, $$-60\text{ mm} < W - W_o < 200\text{ mm}$$

wherein,

W is the width of the unsolidified portion at the entrance side of a plane reducing zone, and $W_o$ is the total compressing width of outer walking bars. The center of $W_o$ corresponds to the center of the cast strand slab width.

Figure 2:
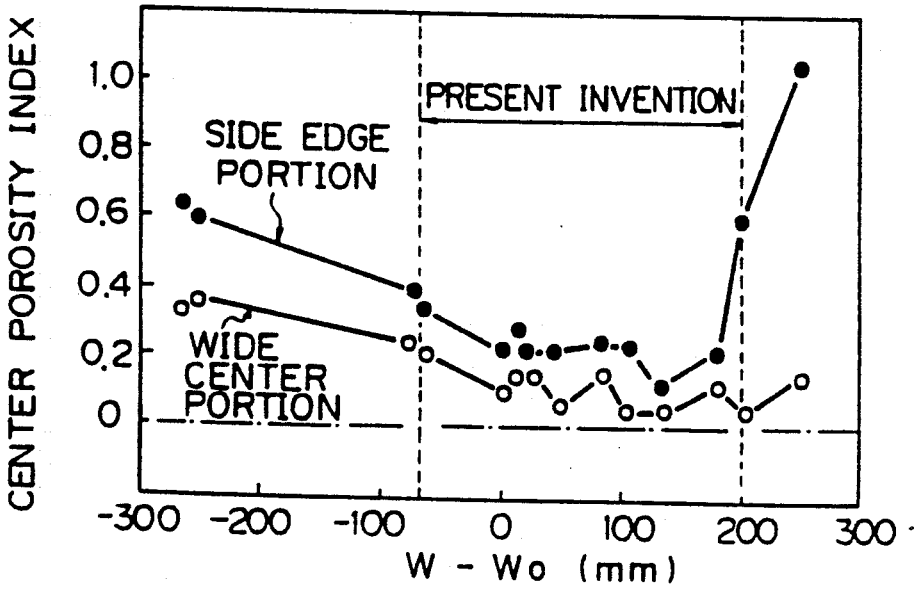
FIG. 2 is a graph of the relationship between the center porosity index and the $W-W_0$ (mm)

FIG. 1 shows the relationship between the above-mentioned "$W-W_o$" obtained taking into account the temperature of the cast steel, the cooling condition of the cast strand slab, and the center segregation thickness index in the cast strand slab width direction. FIG. 2 shows the relationship between the "$W-W_o$" and the center porosity index in the cast strand slab width direction.

In this invention, center porosity is a molding sink caused by solidification shrinkage. The porosity is measured by the specific gravity measuring process and an X-ray flaw detecting process.

From the results shown in FIG. 1, the present inventors found that when the total width of the walking bars used for compression in the plane reducing zone entrance side position is wider than the width of the unsolidified portion of cast strand slab, the solidified shell formed at the two side edges of the strand slab becomes a stopper like spacer hindering the compression near the solidified shell. On the other hand, the present inventors found that when the total width of the walking bars in the plane reducing zone entrance side position is narrower to some extent than the width of an unsolidified portion of a cast strand slab, the compression force does not act on the unsolidified portion near the two slab edge sides in the cast strand slab width direction. The solidification shell near the side edge portions of the strand slab bulges, and center segregation and center porosity are locally generated.

From the results of FIGS. 1 and 2, the present inventors studied how to prevent such phenomena. The compressing width was controlled and varied at the starting time of compression and experiments were carried out with a compression zone $W-W_o$ of from −60 mm to 200 mm. These compressing conditions overcame the problem and proved most superior for producing a cast strand slab which substantially has no center segregation or center porosity.

5) Differences Related To Compression Gradients, Passline Deviation, and Compressing Reaction Force Experiments were conducted using a walking-bar type slab reducing apparatus illustrated in FIGS. 7 to 11 as a compressive gripping means. The inventors obtained the results shown in FIGS. 3 to 6.

Figure 4:
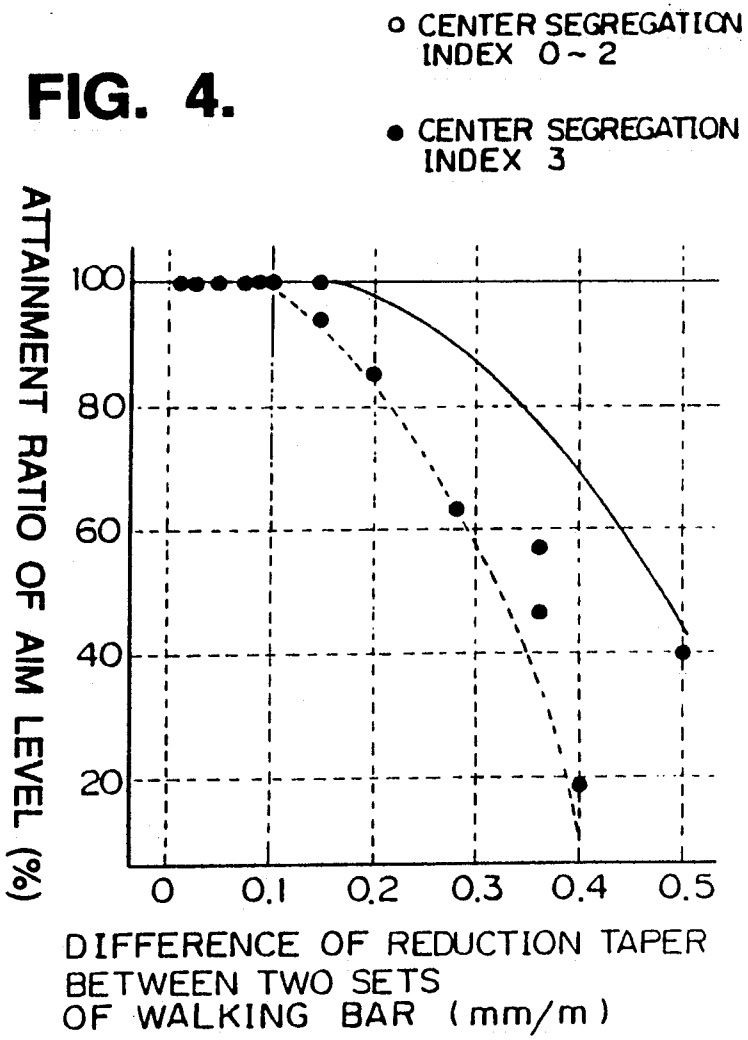
FIGS. 3 to 6 show various data of the present invention.
Figure 3:
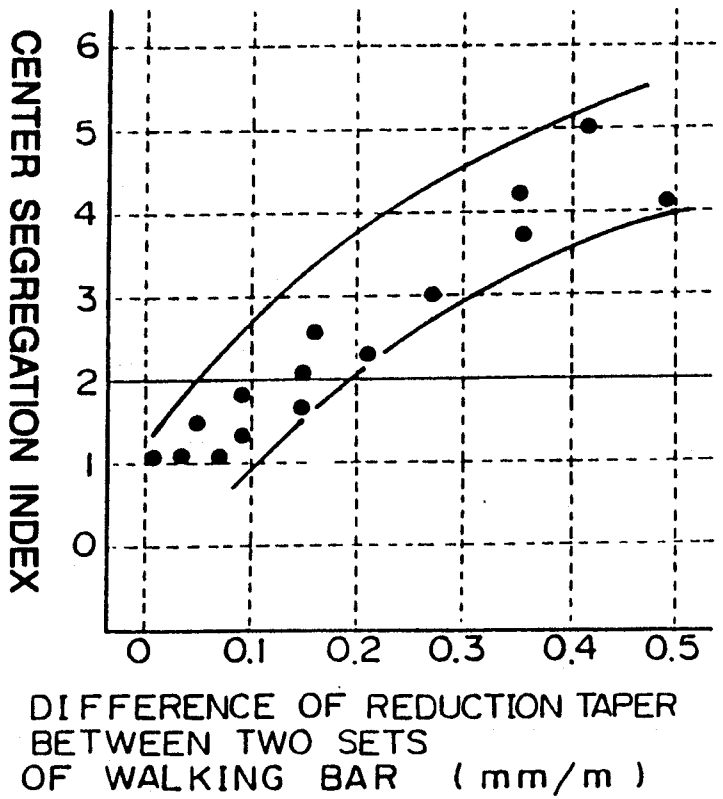
Figure 6:
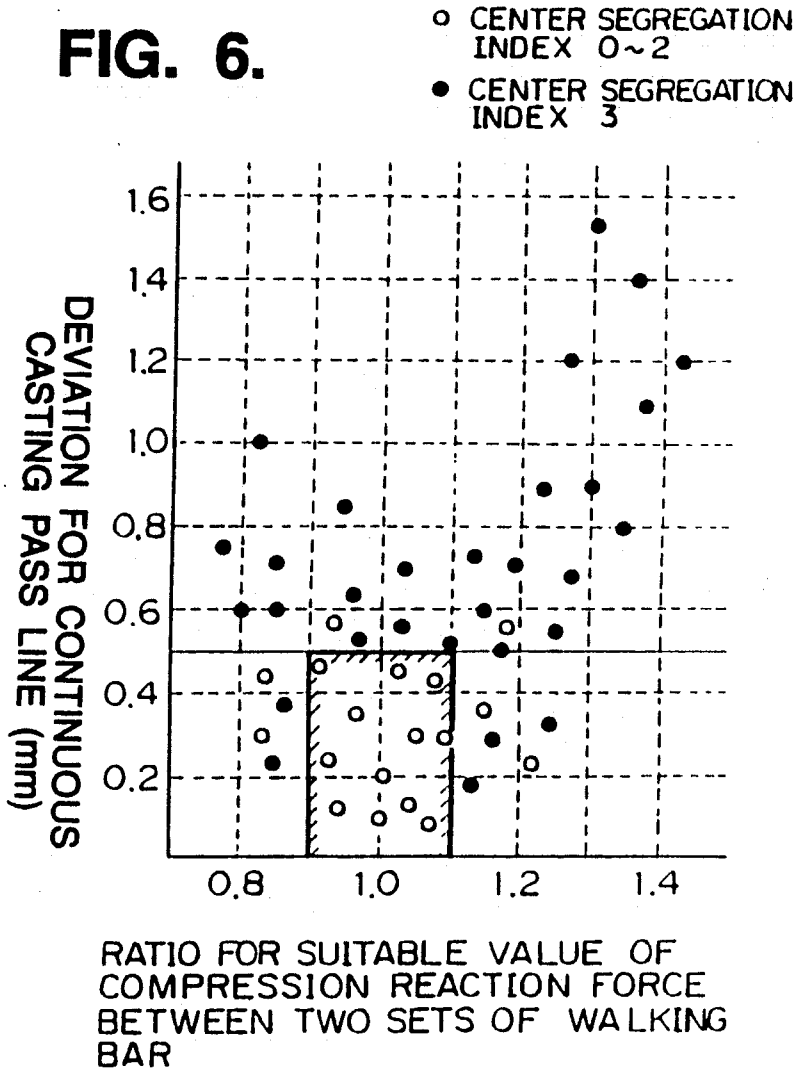

The inventors found from the results of FIGS. 3 and 4 that in a case where surface sections of two sets of walking bars are used, when the difference between the compression gradients or reduction tapers exceed 0.1 mm/m in the width direction of the cast strand slab, the segregation becomes worse.

Namely, when the difference between the reduction tapers of two sets of walking bars exceeds 0.1 mm/m, even if the compression ratio is within a range of 0.5 to 5.0%, the segregation becomes worse. By controlling this difference to be 0.1 mm/m or less, segregation can be eliminated, as is apparent from the examples explained below.

Figure 5:
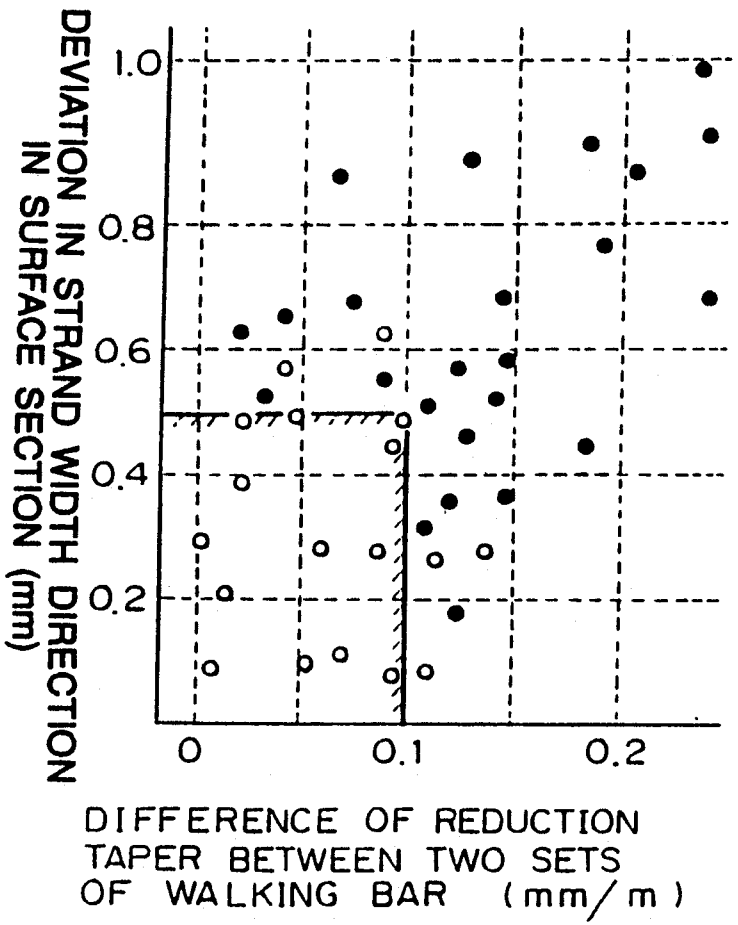

With reference to FIG. 5, the present inventors found that the difference between reduction tapers or compression gradients exceeds 0.1 mm/m when the deviation in the width direction of the slab of the actual passline of the slab's bottom side surface which is supported by the lower walking bars with respect to the passline of the continuous casting machine is greater than 0.5.

The inventors carried out further experiments regarding the case where the difference between the reduction tapers or compression gradients of the two sets of walking bars exceeded 0.1 mm/m. As a result, the inventors found that when the deviation between the passline of the continuous casting machine and an actual passline of the cast slab strand supported by the lower walking bars exceeds 0.5 mm, and even when the deviation is below 0.5 mm, the reduction tapers or compression gradients of the two sets of walking bars differ due to temperature differences across the cast strand width direction caused by non-uniform secondary cooling in the continuous casting machine, non-uniformity of the shape of the unsolidified end portion, or, even when these are uniform, the difference in compression caused by the walking bars in the unsolidified areas and solidified areas having different solidification conditions. The inventors found after various studies on resolution of the problems, that if the passline deviation is 0.5 mm or less and the total reduction ratio, corresponding to solidification shrinkage and the heat shrinkage, is within the range of 0.5 to 5.0%, the required strand slab qualities could be obtained by decreasing the reduction taper of the set of walking bars deviating largest from the desired reduction taper so that difference of the reduction taper of two sets of walking bars becomes 0.1 mm/m or less.

In this case, if the total reduction ratio is within a range from 0.5 to 5.0%, a set of walking bars may be directly lowered to a position of the other set of walking bars having the smaller reduction taper difference from a desired reduction taper. For an improved effect in the center segregation and the center porosity index, it is preferable that the former set of walking bars is gradually lowered so that the reduction taper difference becomes 0.1 mm/m or less. When sensors for detecting the reduction taper operate correctly, the desired qualities of the strand slab can be obtained by the above-mentioned control. However, when sensors are used under severe conditions of high temperature and large amounts of water, the sensors sometimes break.

The present inventors also studied methods of control for reliably obtaining the desired cast strand qualities and arrived at a method related to measurement of reaction forces.

The present inventors discovered a control method directed to detecting the difference between the reduction tapers, the deviations between the actual passline of the bottom of the slab and the passline of the continuous casting machinery, and the deviation of the actual passline in the cast strand slab width direction, comparing the obtained values with the desired values, and controlling the obtained values to a required range. By using this method in a continuous casting process, suitable operation could be continuously carried out.

The surface compression sections, comprised of two sets inner and outer of walking bars of the present invention, differ in compressive gripping positions in the cast strand width direction. This coupled with the temperature deviation in the width direction of the cast strand causes an unavoidable difference in the compressing reaction force of the two inner and the outer sets of walking bars.

There is thus an unavoidable difference in surface compressing reaction force between the two sets of walking bars. Therefore, in the detection of the surface compression reaction force needed for control, it is necessary to consider the unavoidable surface compression reaction force ratio (hereinafter referred to as the suitable surface compressing reaction force ratio). This suitable surface compressing reaction force ratio is more concretely, a ratio of surface compression reaction forces unavoidably caused by the temperature difference of the cast strand slab gripped by the surface compressing sections (walking bars) in a standard operation state.

The present inventors found by experiment that when the ratio of the actual surface compression reaction force ratio to the suitable surface compressing reaction force ratio is controlled to a range from 0.9 to 1.1 (shown by a slanted line in FIG. 6), not only the deterioration of the segregation but also the local generation of the center porosity could be prevented. Further, it was found that the above-mentioned range of from 0.9 to 1.1 did not change either when the total area of the inner set of walking bars for compressing the cast strand slab was equal to that of the outer set, or when the area of the inner set of walking bars for compressing the cast strand slab was not equal to that of the outer set.

Furthermore, the inventors studied a method for detecting the surface compressing reaction force including the steps of: providing a measuring apparatus for measuring the surface compression reaction force at the eccentric cams E which transmit the compressive driving force of hydraulic cylinders 6 and 9 for compressing each bar of the inner walking bars and the outer walking bars of slab reducing apparatus illustrated in FIGS. 7 to 12 and/or at a supporting shaft 2 for the eccentric cams E; inputting the measured reaction force during the surface compression to a comparing apparatus to compare it using the comparing apparatus to a predetermined differential pressure. At the same time, all situations of differential pressure distribution in existence are monitored and the amount of compression between the inner and outer sets of bars are controlled so that the ratio of the actual surface compression reaction force ratio to the suitable surface compression reaction force ratio obtained, based on all different casting conditions such as the type of steel, cooling condition, slab width, etc. during normal operation under standard maintenance conditions, becomes from 0.9 to 1.1.

After the study, the present inventors found that under the above-mentioned standard maintenance conditions, the control of each bar of bar set 7 or 10 is not necessary. When the inner and the outer bar sets are so controlled, the surface compression condition substantially becomes uniform in the strand slab width direction and over the entire surface.

Based on the above, the inventors also found that, when working the present invention, one should control the amount of compression of the strand slab at the entrance side of the walking bars and the exit side of the walking bars by providing a measuring apparatus 20 to measure the surface compressing reaction force at a bearing (not shown) of the common supporting shaft 2 of the inner and outer sets of bars, and controlling the hydraulic cylinders 6 and 9 of the compressing apparatus.

A load cell, a strain gauge, etc. can be used for measuring apparatus 20. The load cell is preferably installed between the bearing and frame when stress acting on the bearing during the driving of the sets of surface compression sections acts on the vertical frame 1.

On the other hand, when the bearing is separated from the vertical frame 1, the measuring apparatus is preferably provided on an anchor bolt provided as the vertical frame 1.

EXAMPLES

A walking-bar type compressive gripping and carrying apparatus for a strand slab, shown in FIGS. 7 to 12, is provided at a compressing zone positioned 34.0 to 36.5 m (desired unsolidified edge portion is about 36 m from the menicus of a curved type continuous casting machine having a radius of curvature of 10.5 m. Using the apparatus, strand slabs having various steel compositions shown in Table 1 and cast at the casting operation conditions shown in Tables 2 to 5 were compressed.

TABLE 1

| Steel | C | Si | Mn | P | S | |
|---|---|---|---|---|---|---|
| A | 0.06–0.10 | 0.10–0.30 | 0.90–1.10 | ≦0.020 | ≦0.005 | Nb, V, Ti, Ni, Ca, Mo |
| B | 0.13–0.18 | 0.20–0.40 | 1.10–1.50 | ≦0.020 | ≦0.005 | Nb, V, Ti, Cu, Ca |
| C | 0.07–0.13 | 0.15–0.35 | 1.30–1.50 | ≦0.020 | ≦0.010 | Ti, Nb, B |

A: Law temperature toughness steel
B: Anti-lameller tear steel
C: Anti-sour gas line pine steel

TABLE 2

| | Example (reduction taper control) | | | | | | | | | | |
|---|---|---|---|---|---|---|---|---|---|---|---|
| | Test No. | Steel | Slab width (mm) | Slab thickness (mm) | Holding width ($W_0$) (mm) | Width of unsolidified portion (W) (mm) | Plane reducing width of unsolidified portion ($W-W_0$) (mm) | Deviation from passline (mm) | Plane reduction ratio before action (%) | reduction taper before action (mm/m) | reduction taper difference between two paired bars |
| Example (invention) | 1 | A | 1820 | 280 | 1620 | 1570 | −50 | 0.1 | 0.9 | 1.0 | 0.01 |
| | 2 | A | 1820 | 280 | 1620 | 1570 | −50 | 0.1 | 0.9 | 1.0 | 0.02 |
| | 3 | A | 1820 | 280 | 1620 | 1570 | −50 | 0.1 | 0.9 | 1.0 | 0.05 |
| | 4 | A | 1820 | 280 | 1620 | 1570 | −50 | 0.1 | 0.9 | 1.0 | 0.08 |
| | 5 | A | 1820 | 280 | 1620 | 1570 | −50 | 0.1 | 0.9 | 1.0 | 0.10 |
| | 6 | A | 1820 | 280 | 1620 | 1570 | −50 | 0.3 | 0.9 | 1.0 | 0.02 |
| | 7 | A | 1820 | 280 | 1620 | 1570 | −50 | 0.3 | 0.9 | 1.0 | 0.05 |
| | 8 | A | 1820 | 280 | 1620 | 1570 | −50 | 0.3 | 0.9 | 1.0 | 0.07 |
| | 9 | A | 1820 | 280 | 1620 | 1570 | −50 | 0.3 | 0.9 | 1.0 | 0.10 |
| | 10 | A | 1820 | 280 | 1620 | 1570 | −50 | 0.5 | 0.9 | 1.0 | 0.02 |
| | 11 | A | 1820 | 280 | 1620 | 1570 | −50 | 0.5 | 0.9 | 1.0 | 0.05 |
| | 12 | A | 1820 | 280 | 1620 | 1570 | −50 | 0.5 | 0.9 | 1.0 | 0.10 |
| | 13 | B | 1820 | 280 | 1620 | 1570 | −50 | 0.1 | 0.9 | 1.0 | 0.01 |
| | 14 | B | 1820 | 280 | 1620 | 1570 | −50 | 0.1 | 0.9 | 1.0 | 0.05 |
| | 15 | B | 1820 | 280 | 1620 | 1570 | −50 | 0.1 | 0.9 | 1.0 | 0.08 |
| | 16 | B | 1820 | 280 | 1620 | 1570 | −50 | 0.1 | 0.9 | 1.0 | 0.10 |
| | 17 | B | 1820 | 280 | 1620 | 1570 | −50 | 0.3 | 0.9 | 1.0 | 0.10 |
| | 18 | B | 1820 | 280 | 1620 | 1570 | −50 | 0.5 | 0.9 | 1.0 | 0.10 |
| | 19 | C | 1820 | 280 | 1620 | 1570 | −50 | 0.1 | 0.9 | 1.0 | 0.10 |
| | 20 | C | 1820 | 280 | 1620 | 1570 | −50 | 0.3 | 0.9 | 1.0 | 0.02 |
| | 21 | C | 1820 | 280 | 1620 | 1570 | −50 | 0.5 | 0.9 | 1.0 | 0.01 |
| | 22 | C | 1820 | 280 | 1620 | 1570 | −50 | 0.5 | 0.9 | 1.0 | 0.10 |
| | 23 | A | 1830 | 280 | 1620 | 1590 | −30 | 0.1 | 0.9 | 1.0 | 0.01 |
| | 24 | A | 1830 | 280 | 1620 | 1590 | −30 | 0.1 | 0.9 | 1.0 | 0.10 |
| | 25 | A | 1830 | 280 | 1620 | 1590 | −30 | 0.3 | 0.9 | 1.0 | 0.02 |
| | 26 | A | 1830 | 280 | 1620 | 1590 | −30 | 0.3 | 0.9 | 1.0 | 0.08 |
| | 27 | A | 1830 | 280 | 1620 | 1590 | −30 | 0.5 | 0.9 | 1.0 | 0.02 |
| | 28 | A | 1830 | 280 | 1620 | 1590 | −30 | 0.5 | 0.9 | 1.0 | 0.09 |
| | 29 | A | 1870 | 280 | 1620 | 1620 | ±0 | 0.1 | 0.9 | 1.0 | 0.01 |
| | 30 | A | 1870 | 280 | 1620 | 1620 | ±0 | 0.1 | 0.9 | 1.0 | 0.05 |
| | 31 | A | 1870 | 280 | 1620 | 1620 | ±0 | 0.1 | 0.9 | 1.0 | 0.10 |
| | 32 | A | 1870 | 280 | 1620 | 1620 | ±0 | 0.3 | 0.9 | 1.0 | 0.06 |
| | 33 | A | 1870 | 280 | 1620 | 1620 | ±0 | 0.3 | 0.9 | 1.0 | 0.09 |
| | 34 | A | 1870 | 280 | 1620 | 1620 | ±0 | 0.5 | 0.9 | 1.0 | 0.02 |
| | 35 | A | 1870 | 280 | 1620 | 1620 | ±0 | 0.5 | 0.9 | 1.0 | 0.10 |
| | 36 | A | 1970 | 280 | 1620 | 1720 | 100 | 0.1 | 0.9 | 1.0 | 0.10 |
| | 38 | A | 1970 | 280 | 1620 | 1720 | 100 | 0.3 | 0.9 | 1.0 | 0.09 |
| | 39 | A | 1970 | 280 | 1620 | 1720 | 100 | 0.5 | 0.9 | 1.0 | 0.01 |
| | 40 | A | 1970 | 280 | 1620 | 1720 | 100 | 0.5 | 0.9 | 1.0 | 0.10 |
| | 41 | A | 2000 | 200 | 1620 | 1820 | 200 | 0.1 | 1.0 | 1.0 | 0.01 |
| | 42 | A | 2000 | 200 | 1620 | 1820 | 200 | 0.1 | 1.0 | 1.0 | 0.10 |
| | 43 | A | 2000 | 200 | 1620 | 1830 | 200 | 0.3 | 1.0 | 1.0 | 0.10 |
| | 44 | A | 2000 | 200 | 1620 | 1830 | 200 | 0.5 | 1.0 | 1.0 | 0.09 |
| | 45 | A | 1210 | 250 | 840 | 990 | 150 | 0.1 | 1.25 | 1.0 | 0.01 |
| | 46 | A | 1210 | 250 | 840 | 990 | 150 | 0.1 | 1.25 | 1.0 | 0.10 |
| | 47 | A | 1210 | 250 | 840 | 990 | 150 | 0.5 | 1.25 | 1.0 | 0.09 |
| | 48 | A | 1720 | 50 | 1620 | 1680 | 60 | 0.1 | 2.5 | 0.5 | 0.01 |
| | 49 | A | 1720 | 50 | 1620 | 1680 | 60 | 0.1 | 2.5 | 0.5 | 0.10 |
| | 50 | A | 1720 | 50 | 1620 | 1680 | 60 | 0.5 | 2.5 | 0.5 | 0.10 |
| | 51 | A | 1270 | 50 | 1230 | 1230 | 0 | 0.1 | 2.5 | 0.5 | 0.09 |
| | 52 | A | 1270 | 50 | 1230 | 1230 | 0 | 0.5 | 2.5 | 0.5 | 0.10 |

TABLE 2-continued

| Example (reduction taper control) | | | | | | | |
|---|---|---|---|---|---|---|---|
| Test No. | Control | plane reducing ratio after action (%) | reduction taper (after action) (mm/m) | taper difference between two paired bars (after action) (mm/m) | Center segregation index | Center porosity index | Remarks |
| 1 | NO | — | — | — | 0–1 | 0.02 | pass line difference: |
| 2 | NO | — | — | — | 0–1 | 0.05 | Δ= 0.1 mm |
| 3 | NO | — | — | — | 0–2 | 0.15 | ↑: bar gradient |
| 4 | NO | — | — | — | 0–2 | 0.10 | difference |
| 5 | NO | — | — | — | 1–2 | 0.20 | |
| 6 | NO | — | — | — | 0–1 | 0.05 | Δ = 0.3 mm |
| 7 | NO | — | — | — | 0–2 | 0.10 | Δ = 0.5 mm |
| 8 | NO | — | — | — | 1–2 | 0.16 | |
| 9 | NO | — | — | — | 1–2 | 0.21 | |
| 10 | NO | — | — | — | 0–2 | 0.09 | |
| 11 | NO | — | — | — | 1–2 | 0.15 | |
| 12 | NO | — | — | — | 1–2 | 0.22 | |
| 13 | NO | — | — | — | 0–1 | 0.05 | Steel: B |
| 14 | NO | — | — | — | 0–2 | 0.10 | Δ = 0.1–0.5 |
| 15 | NO | — | — | — | 1–2 | 0.19 | δ = 0.01–0.10 |
| 16 | NO | — | — | — | 1–2 | 0.21 | |
| 17 | NO | — | — | — | 1–2 | 0.12 | |
| 18 | NO | — | — | — | 1–2 | 0.23 | |
| 19 | NO | — | — | — | 1–2 | 0.15 | Steel: C |
| 20 | NO | — | — | — | 0–2 | 0.10 | δ = 0.01–0.10 |
| 21 | NO | — | — | — | 1–2 | 0.15 | |
| 22 | NO | — | — | — | 1–2 | 0.21 | |
| 23 | NO | — | — | — | 0–1 | 0.03 | $W-W_0 = -25$ |
| 24 | NO | — | — | — | 1–2 | 0.20 | |
| 25 | NO | — | — | — | 0–2 | 0.09 | |
| 26 | NO | — | — | — | 1–2 | 0.12 | |
| 27 | NO | — | — | — | 1–2 | 0.15 | |
| 28 | NO | — | — | — | 1–2 | 0.22 | |
| 29 | NO | — | — | — | 0–1 | 0.02 | $W-W_0 = \pm 25$ |
| 30 | NO | — | — | — | 0–2 | 0.18 | |
| 31 | NO | — | — | — | 1–2 | 0.10 | |
| 32 | NO | — | — | — | 1–2 | 0.25 | |
| 33 | NO | — | — | — | 1–2 | 0.19 | |
| 34 | NO | — | — | — | 1–2 | 0.10 | |
| 35 | NO | — | — | — | 1–2 | 0.23 | |
| 36 | NO | — | — | — | 1–2 | 0.19 | $W-W_0 = 100$ |
| 38 | NO | — | — | — | 1–2 | 0.20 | |
| 39 | NO | — | — | — | 1–2 | 0.22 | |
| 40 | NO | — | — | — | 1–2 | 0.24 | |
| 41 | NO | — | — | — | 0–2 | 0.05 | $W-W_0 = 200$ |
| 42 | NO | — | — | — | 1–2 | 0.10 | |
| 43 | NO | — | — | — | 1–2 | 0.19 | |
| 44 | NO | — | — | — | 1–2 | 0.21 | |
| 45 | NO | — | — | — | 0–1 | 0.02 | |
| 46 | NO | — | — | — | 1–2 | 0.16 | |
| 47 | NO | — | — | — | 1–2 | 0.22 | |
| 48 | NO | — | — | — | 0–1 | 0.10 | |
| 49 | NO | — | — | — | 0–2 | 0.20 | |
| 50 | NO | — | — | — | 1–2 | 0.23 | |
| 51 | NO | — | — | — | 1–2 | 0.19 | |
| 52 | NO | — | — | — | 1–2 | 0.22 | |

TABLE 3

| Example (reduction taper control) | | | | | | | | | | | |
|---|---|---|---|---|---|---|---|---|---|---|---|
| | Test No. | Steel | Slab width (mm) | Slab thickness (mm) | Holding width ($W_0$) (mm) | Width of unsolidified portion (W) (mm) | Plane reducing width of unsolidified portion ($W-W_0$) (mm) | Deviation from passline (mm) | Plane reduction ratio before action (%) | Reduction taper before action (mm/m) | Reduction taper difference between two paired bars |
| Example (invention) | 53 | A | 1820 | 280 | 1620 | 1570 | −50 | 0.1 | 0.9 | 1.0 | 0.12 |
| | 54 | A | 1820 | 280 | 1620 | 1570 | −50 | 0.1 | 0.9 | 1.0 | 0.15 |
| | 55 | A | 1820 | 280 | 1620 | 1570 | −50 | 0.1 | 0.9 | 1.0 | 0.20 |
| | 56 | A | 1820 | 280 | 1620 | 1570 | −50 | 0.1 | 0.9 | 1.0 | 0.25 |
| | 57 | A | 1820 | 280 | 1620 | 1570 | −50 | 0.3 | 0.9 | 1.0 | 0.13 |
| | 58 | A | 1820 | 280 | 1620 | 1570 | −50 | 0.3 | 0.9 | 1.0 | 0.17 |
| | 59 | A | 1820 | 280 | 1620 | 1570 | −50 | 0.3 | 0.9 | 1.0 | 0.20 |
| | 60 | A | 1820 | 280 | 1620 | 1570 | −50 | 0.5 | 0.9 | 1.0 | 0.15 |
| | 61 | A | 1820 | 280 | 1620 | 1570 | −50 | 0.5 | 0.9 | 1.0 | 0.15 |
| | 62 | A | 1820 | 280 | 1620 | 1570 | −50 | 0.5 | 0.9 | 1.0 | 0.20 |
| | 63 | B | 1820 | 280 | 1620 | 1570 | −50 | 0.1 | 0.9 | 1.0 | 0.02 |
| | 64 | B | 1820 | 280 | 1620 | 1570 | −50 | 0.1 | 0.9 | 1.0 | 0.15 |

TABLE 3-continued

Example (reduction taper control)

| | | | | | | | | | | |
|---|---|---|---|---|---|---|---|---|---|---|
| 65 | B | 1820 | 280 | 1620 | 1570 | −50 | 0.1 | 0.9 | 1.0 | 0.18 |
| 66 | B | 1820 | 280 | 1620 | 1570 | −50 | 0.1 | 0.9 | 1.0 | 0.20 |
| 67 | B | 1820 | 280 | 1620 | 1570 | −50 | 0.3 | 0.9 | 1.0 | 0.25 |
| 68 | B | 1820 | 280 | 1620 | 1570 | −50 | 0.5 | 0.9 | 1.0 | 0.40 |
| 69 | C | 1820 | 280 | 1620 | 1570 | −50 | 0.1 | 0.9 | 1.0 | 0.11 |
| 70 | C | 1820 | 280 | 1620 | 1570 | −50 | 0.3 | 0.9 | 1.0 | 0.15 |
| 71 | C | 1820 | 280 | 1620 | 1570 | −50 | 0.5 | 0.9 | 1.0 | 0.21 |
| 72 | C | 1820 | 280 | 1620 | 1570 | −50 | 0.5 | 0.9 | 1.0 | 0.30 |
| 74 | A | 1830 | 280 | 1620 | 1590 | −30 | 0.1 | 0.9 | 1.0 | 0.11 |
| 75 | A | 1830 | 280 | 1620 | 1590 | −30 | 0.1 | 0.9 | 1.0 | 0.20 |
| 76 | A | 1830 | 280 | 1620 | 1590 | −30 | 0.3 | 0.9 | 1.0 | 0.22 |
| 77 | A | 1830 | 280 | 1620 | 1590 | −30 | 0.3 | 0.9 | 1.0 | 0.18 |
| 78 | A | 1830 | 280 | 1620 | 1590 | −30 | 1.5 | 0.9 | 1.0 | 0.31 |
| 79 | A | 1870 | 280 | 1620 | 1620 | ±0 | 0.1 | 0.9 | 1.0 | 0.11 |
| 80 | A | 1870 | 280 | 1620 | 1620 | ±0 | 0.1 | 0.9 | 1.0 | 0.25 |
| 81 | A | 1870 | 280 | 1620 | 1620 | ±0 | 0.3 | 0.9 | 1.0 | 0.46 |
| 82 | A | 1870 | 280 | 1620 | 1620 | ±0 | 0.5 | 0.9 | 1.0 | 0.32 |
| 83 | A | 1970 | 280 | 1620 | 1720 | 100 | 0.1 | 0.9 | 1.0 | 0.15 |
| 84 | A | 1970 | 280 | 1620 | 1720 | 100 | 0.3 | 0.9 | 1.0 | 0.19 |
| 85 | A | 1970 | 280 | 1620 | 1720 | 100 | 0.5 | 0.9 | 1.0 | 0.54 |
| 86 | A | 2050 | 250 | 1620 | 1820 | 200 | 0.1 | 1.0 | 1.0 | 0.12 |
| 87 | A | 2050 | 250 | 1620 | 1820 | 200 | 0.3 | 1.0 | 1.0 | 0.21 |
| 88 | A | 2050 | 250 | 1620 | 1820 | 200 | 0.5 | 1.0 | 1.0 | 0.19 |
| 89 | C | 1210 | 250 | 840 | 990 | 150 | 0.1 | 1.25 | 1.0 | 0.12 |
| 90 | C | 1210 | 250 | 840 | 990 | 150 | 0.5 | 1.25 | 1.0 | 0.29 |
| 91 | A | 1720 | 50 | 1620 | 1680 | 60 | 0.1 | 2.5 | 0.5 | 0.11 |
| 92 | A | 1720 | 50 | 1620 | 1680 | 60 | 0.5 | 2.5 | 0.5 | 0.20 |
| 93 | A | 1270 | 50 | 1230 | 1230 | 0 | 0.5 | 3.5 | 0.7 | 0.19 |
| 94 | A | 1820 | 280 | 1620 | 1570 | −50 | 0.1 | 0.9 | 1.0 | 0.11 |
| 95 | A | 1820 | 280 | 1620 | 1570 | −50 | 0.6 | 0.9 | 1.0 | 0.02 |
| 96 | A | 1820 | 280 | 1620 | 1690 | −70 | 0.1 | 0.9 | 1.0 | 0.05 |
| 97 | A | 1820 | 280 | 1620 | 1830 | 210 | 0.1 | 0.9 | 1.0 | 0.05 |
| 98 | A | 1820 | 280 | 1620 | 1570 | −50 | 0.1 | 0.45 | 0.5 | 0.01 |
| 99 | A | 1820 | 280 | 1620 | 1570 | −50 | 0.1 | 5.1 | 5.7 | 0.02 |
| 100 | A | 1820 | 280 | 1620 | 1570 | −50 | 0.1 | 0.9 | 1.0 | 0.15 |
| 101 | A | 1820 | 280 | 1620 | 1570 | −50 | 0.1 | 0.9 | 1.0 | 0.18 |
| 102 | B | 1820 | 280 | 1620 | 1570 | −50 | 0.1 | 0.9 | 1.0 | 0.11 |
| 103 | B | 1820 | 280 | 1620 | 1570 | −50 | 0.6 | 0.9 | 1.0 | 0.23 |
| 104 | C | 1820 | 280 | 1620 | 1570 | −50 | 0.2 | 0.9 | 1.0 | 0.22 |

| Test No. | Control | reduction taper after action (%) | reduction taper (after action) (mm/m) | Taper difference between two paired bars (after action) (mm/m) | Center segregation index | Center porosity index | Remarks |
|---|---|---|---|---|---|---|---|
| 53 | YES | 0.85 | 0.95 | 0.02 | 0–1 | 0.02 | |
| 54 | YES | 0.85 | 0.95 | 0.10 | 1–2 | 0.15 | |
| 55 | YES | 0.71 | 0.80 | 0 | 0–1 | 0.02 | |
| 56 | YES | 0.76 | 0.85 | 0.10 | 1–2 | 0.10 | |
| 57 | YES | 0.80 | 0.90 | 0.03 | 0–1 | 0.05 | |
| 58 | YES | 0.85 | 0.95 | 0.02 | 0–1 | 0.10 | |
| 59 | YES | 0.71 | 0.80 | 0 | 0–1 | 0.06 | |
| 60 | YES | 0.85 | 0.95 | 0 | 0–1 | 0.05 | |
| 61 | YES | 0.85 | 0.95 | 0.10 | 1–2 | 0.21 | |
| 62 | YES | 0.81 | 0.91 | 0.09 | 1–2 | 0.22 | |
| 63 | YES | 0.88 | 0.98 | 0 | 0–1 | 0.02 | |
| 64 | YES | 0.80 | 0.90 | 0.10 | 1–2 | 0.22 | |
| 65 | YES | 0.71 | 0.80 | 0.02 | 0–1 | 0.09 | |
| 66 | YES | 0.71 | 0.80 | 0 | 0–1 | 0.01 | |
| 67 | YES | 0.76 | 0.85 | 0.10 | 0–2 | 0.11 | |
| 68 | YES | 0.54 | 0.60 | 0 | 0–1 | 0.03 | |
| 69 | YES | 0.85 | 0.95 | 0.06 | 0–2 | 0.15 | |
| 70 | YES | 0.80 | 0.90 | 0.05 | 0–2 | 0.10 | |
| 71 | YES | 0.81 | 0.91 | 0.10 | 1–2 | 0.21 | |
| 72 | YES | 0.71 | 0.80 | 0.10 | 1–2 | 0.23 | |
| 74 | YES | 0.80 | 0.90 | 0.01 | 0–1 | 0.03 | |
| 75 | YES | 0.80 | 0.90 | 0.10 | 1–2 | 0.20 | |
| 76 | YES | 0.76 | 0.85 | 0.07 | 0–2 | 0.11 | |
| 77 | YES | 0.65 | 0.73 | 0.09 | 0–2 | 0.12 | |
| 78 | YES | 0.54 | 0.60 | 0.09 | 1–2 | 0.15 | |
| 79 | YES | 0.88 | 0.99 | 0.10 | 1–2 | 0.12 | |
| 80 | YES | 0.71 | 0.80 | 0.05 | 0–2 | 0.08 | |
| 81 | YES | 0.58 | 0.65 | 0.09 | 1–2 | 0.15 | |
| 82 | YES | 0.67 | 0.75 | 0.07 | 1–2 | 0.20 | |
| 83 | YES | 0.85 | 0.95 | 0.10 | 1–2 | 0.09 | |
| 84 | YES | 0.80 | 0.90 | 0.09 | 1–2 | 0.12 | |
| 85 | YES | 0.57 | 0.64 | 0.10 | 1–2 | 0.22 | |
| 86 | YES | 0.98 | 0.98 | 0.10 | 1–2 | 0.16 | |
| 87 | YES | 0.85 | 0.85 | 0.06 | 0–2 | 0.13 | |
| 88 | YES | 0.90 | 0.90 | 0.09 | 1–2 | 0.24 | |
| 89 | YES | 1.19 | 0.95 | 0.07 | 0–2 | 0.09 | |

TABLE 3-continued

| Example (reduction taper control) | | | | | | |
|---|---|---|---|---|---|---|
| 90 | YES | 1.00 | 0.80 | 0.09 | 1–2 | 0.22 |
| 91 | YES | 2.00 | 0.40 | 0.01 | 0–2 | 0.10 |
| 92 | YES | 2.00 | 0.40 | 0.10 | 1–2 | 0.20 |
| 93 | YES | 3.00 | 0.60 | 0.09 | 1–2 | 0.19 |
| 94 | NO | — | — | — | 1–4 | 0.45 |
| 95 | NO | — | — | — | 2–5 | 1.06 |
| 96 | NO | — | — | — | 2–4 | 0.65 |
| 97 | NO | — | — | — | 1–5 | 1.11 |
| 98 | NO | — | — | — | 2–6 | 2.61 |
| 99 | NO | — | — | — | 1–5 | 1.01 |
| 100 | YES | 0.88 | 0.98 | 0.13 | 0–5 | 0.94 |
| 101 | YES | 0.84 | 0.94 | 0.12 | 0–4 | 0.39 |
| 102 | NO | — | | — | 1–4 | 0.62 |
| 103 | YES | 0.80 | 0.90 | 0.13 | 2–4 | 0.83 |
| 104 | YES | 0.80 | 0.90 | 0.12 | 1–5 | 1.59 |

TABLE 4

| Example (reduction taper control) | | | | | | | | | | |
|---|---|---|---|---|---|---|---|---|---|---|
| Test No. | Steel | Slab width (mm) | Slab thickness (mm) | Holding width ($W_0$) (mm) | Width of unsolidified portion (W) (mm) | Plane reducing width of unsolidified portion ($W-W_0$) (mm) | Deviation from passline (mm) | Plane reducing ratio before action (%) | Reduction taper before action (mm/m) | Suitable plane reducing reaction force ratio |
| Example (invention) | | | | | | | | | | |
| 1 | A | 1820 | 280 | 1620 | 1570 | −50 | 0.1 | 0.9 | 1.0 | 0.85 |
| 2 | A | 1820 | 280 | 1620 | 1570 | −50 | 0.1 | 0.9 | 1.0 | 0.85 |
| 3 | A | 1820 | 280 | 1620 | 1570 | −50 | 0.1 | 0.9 | 1.0 | 0.85 |
| 4 | A | 1820 | 280 | 1620 | 1570 | −50 | 0.3 | 0.9 | 1.0 | 0.85 |
| 5 | A | 1820 | 280 | 1620 | 1570 | −50 | 0.3 | 0.9 | 1.0 | 0.85 |
| 6 | A | 1820 | 280 | 1620 | 1570 | −50 | 0.3 | 0.9 | 1.0 | 0.85 |
| 7 | A | 1820 | 280 | 1620 | 1570 | −50 | 0.5 | 0.9 | 1.0 | 0.85 |
| 8 | A | 1820 | 280 | 1620 | 1570 | −50 | 0.5 | 0.9 | 1.0 | 0.85 |
| 9 | A | 1820 | 280 | 1620 | 1570 | −50 | 0.5 | 0.9 | 1.0 | 0.85 |
| 10 | B | 1820 | 280 | 1620 | 1570 | −50 | 0.1 | 0.9 | 1.0 | 0.90 |
| 11 | B | 1820 | 280 | 1620 | 1570 | −50 | 0.1 | 0.9 | 1.0 | 0.90 |
| 12 | B | 1820 | 280 | 1620 | 1570 | −50 | 0.1 | 0.9 | 1.0 | 0.90 |
| 13 | B | 1820 | 280 | 1620 | 1570 | −50 | 0.5 | 0.9 | 1.0 | 0.90 |
| 14 | B | 1820 | 280 | 1620 | 1570 | −50 | 0.5 | 0.9 | 1.0 | 0.90 |
| 15 | C | 1820 | 280 | 1620 | 1570 | −50 | 0.1 | 0.9 | 1.0 | 0.95 |
| 16 | C | 1820 | 280 | 1620 | 1570 | −50 | 0.1 | 0.9 | 1.0 | 0.95 |
| 17 | C | 1820 | 280 | 1620 | 1570 | −50 | 0.1 | 0.9 | 1.0 | 0.95 |
| 18 | C | 1820 | 280 | 1620 | 1570 | −50 | 0.5 | 0.9 | 1.0 | 0.95 |
| 19 | C | 1820 | 280 | 1620 | 1570 | −50 | 0.5 | 0.9 | 1.0 | 0.95 |
| 20 | A | 1830 | 280 | 1620 | 1590 | −30 | 0.1 | 0.9 | 1.0 | 0.87 |
| 21 | A | 1830 | 280 | 1620 | 1590 | −30 | 0.1 | 0.9 | 1.0 | 0.87 |
| 22 | A | 1830 | 280 | 1620 | 1590 | −30 | 0.3 | 0.9 | 1.0 | 0.87 |
| 23 | A | 1830 | 280 | 1620 | 1590 | −30 | 0.3 | 0.9 | 1.0 | 0.87 |
| 24 | A | 1830 | 280 | 1620 | 1590 | −30 | 0.5 | 0.9 | 1.0 | 0.87 |
| 25 | A | 1870 | 280 | 1620 | 1620 | ±0 | 0.1 | 0.9 | 1.0 | 0.89 |
| 26 | A | 1870 | 280 | 1620 | 1620 | ±0 | 0.1 | 0.9 | 1.0 | 0.89 |
| 27 | A | 1870 | 280 | 1620 | 1620 | ±0 | 0.3 | 0.9 | 1.0 | 0.89 |
| 28 | A | 1870 | 280 | 1620 | 1620 | ±0 | 0.5 | 0.9 | 1.0 | 0.89 |
| 29 | A | 1870 | 280 | 1620 | 1620 | ±0 | 0.5 | 0.9 | 1.0 | 0.89 |
| 30 | A | 1970 | 280 | 1620 | 1720 | 100 | 0.5 | 0.9 | 1.0 | 0.98 |
| 31 | A | 1970 | 280 | 1620 | 1720 | 100 | 0.5 | 0.9 | 1.0 | 0.98 |
| 32 | A | 2000 | 200 | 1620 | 1820 | 200 | 0.1 | 1.0 | 1.0 | 1.00 |
| 33 | A | 2000 | 200 | 1620 | 1820 | 200 | 0.1 | 1.0 | 1.0 | 1.00 |
| 34 | A | 1210 | 250 | 840 | 990 | 150 | 0.1 | 1.25 | 1.0 | 1.00 |
| 35 | A | 1210 | 250 | 840 | 990 | 150 | 0.1 | 1.25 | 1.0 | 1.00 |
| 36 | A | 1210 | 250 | 840 | 990 | 150 | 0.1 | 1.25 | 1.0 | 1.00 |
| 38 | A | 1210 | 250 | 840 | 990 | 150 | 0.5 | 3.0 | 2.4 | 0.98 |
| 39 | A | 1210 | 250 | 840 | 990 | 150 | 0.5 | 3.0 | 2.4 | 0.98 |
| 40 | A | 1870 | 250 | 1620 | 1650 | 30 | 0.1 | 5.0 | 5.0 | 0.92 |
| 41 | A | 1870 | 250 | 1620 | 1650 | 30 | 0.1 | 5.0 | 5.0 | 0.92 |
| 42 | A | 1870 | 250 | 1620 | 1650 | 30 | 0.1 | 5.0 | 5.0 | 0.92 |
| 43 | A | 1870 | 250 | 1620 | 1650 | 30 | 0.3 | 3.5 | 3.5 | 0.94 |
| 44 | A | 1870 | 250 | 1620 | 1650 | 30 | 0.3 | 3.5 | 3.5 | 0.94 |
| 45 | A | 1870 | 250 | 1620 | 1650 | 30 | 0.5 | 1.2 | 1.2 | 0.97 |
| 46 | A | 1870 | 250 | 1620 | 1650 | 30 | 0.5 | 1.2 | 1.2 | 0.97 |
| 47 | A | 1700 | 50 | 1620 | 1650 | 40 | 0.1 | 2.5 | 0.5 | 1.00 |
| 48 | A | 1700 | 50 | 1620 | 1650 | 40 | 0.1 | 2.5 | 0.5 | 1.00 |
| 49 | A | 1700 | 50 | 1620 | 1650 | 40 | 0.1 | 2.5 | 0.5 | 1.00 |
| 50 | A | 1270 | 50 | 1230 | 1230 | 0 | 0.5 | 2.5 | 0.5 | 0.98 |
| 51 | A | 1270 | 50 | 1230 | 1230 | 0 | 0.5 | 2.5 | 0.5 | 0.98 |
| 52 | A | 1270 | 50 | 1230 | 1230 | 0 | 0.5 | 2.5 | 0.5 | 0.98 |
| | | | | Actual | Actual | | | | | |

TABLE 4-continued

Example (reduction taper control)

| Test No. | Control | Plane reduction ratio (%) | plane reducing reaction force ratio (before control) | plane reducing reaction force ratio (after control) | Actual reaction force ratio Suitable reaction force ratio (before control) | Actual reaction force ratio Suitable reaction force ratio (after control) | Center segregation index | Center porosity index | Remarks |
|---|---|---|---|---|---|---|---|---|---|
| 1 | NO | 0.91 | 0.86 | — | 1.01 | — | 0–1 | 0.02 | pass line difference |
| 2 | NO | 0.94 | 0.93 | — | 1.09 | — | 1–2 | 0.10 | |
| 3 | NO | 0.84 | 0.77 | — | 0.91 | — | 1–2 | 0.15 | Δ - 0.1 mm |
| 4 | NO | 0.85 | 0.85 | — | 1.00 | — | 0–1 | 0.05 | Δ - 0.5 mm |
| 5 | NO | 0.96 | 0.92 | — | 1.08 | — | 1–2 | 0.20 | |
| 6 | NO | 0.82 | 0.78 | — | 0.92 | — | 0–2 | 0.15 | |
| 7 | NO | 0.88 | 0.87 | — | 1.02 | — | 0–1 | 0.10 | Δ - 0.5 mm |
| 8 | NO | 0.95 | 0.93 | — | 1.09 | — | 1–2 | 0.16 | |
| 9 | NO | 0.82 | 0.78 | — | 0.92 | — | 1–2 | 0.13 | |
| 10 | NO | 0.89 | 0.89 | — | 0.99 | — | 0–2 | 0.05 | steel B |
| 11 | NO | 0.99 | 0.99 | — | 1.10 | — | 1–2 | 0.15 | |
| 12 | NO | 0.81 | 0.82 | — | 0.91 | — | 1–2 | 0.22 | |
| 13 | NO | 0.83 | 0.81 | — | 0.90 | — | 1–2 | 0.15 | |
| 14 | NO | 0.97 | 0.98 | — | 1.09 | — | 1–2 | 0.21 | |
| 15 | NO | 0.97 | 0.95 | — | 1.00 | — | 0–1 | 0.08 | steel C |
| 16 | NO | 0.97 | 1.04 | — | 1.09 | — | 1–2 | 0.21 | |
| 17 | NO | 0.88 | 0.86 | — | 0.91 | — | 1–2 | 0.17 | |
| 18 | NO | 0.95 | 1.03 | — | 1.08 | — | 1–2 | 0.23 | |
| 19 | NO | 0.86 | 0.87 | — | 0.92 | — | 1–2 | 0.22 | |
| 20 | NO | 0.92 | 0.95 | — | 1.09 | — | 1–2 | 0.18 | $W - W_0 = -25$ mm |
| 21 | NO | 0.80 | 0.79 | — | 0.91 | — | 1–2 | 0.20 | |
| 22 | NO | 0.91 | 0.93 | — | 1.07 | — | 0–2 | 0.13 | |
| 23 | NO | 0.92 | 0.94 | — | 1.08 | — | 1–2 | 0.17 | |
| 24 | NO | 0.82 | 0.80 | — | 0.92 | — | 1–2 | 0.15 | |
| 25 | NO | 0.96 | 0.97 | — | 1.09 | — | 1–2 | 0.12 | $W - W_0 = \pm 0$ mm |
| 26 | NO | 0.83 | 0.81 | — | 0.91 | — | 1–2 | 0.18 | |
| 27 | NO | 0.95 | 0.96 | — | 1.08 | — | 1–2 | 0.20 | |
| 28 | NO | 0.94 | 0.97 | — | 1.09 | — | 1–2 | 0.23 | |
| 29 | NO | 0.85 | 0.82 | — | 0.92 | — | 1–2 | 0.25 | |
| 30 | NO | 0.99 | 0.07 | — | 1.09 | — | 1–2 | 0.22 | $W - W_0 = 100$ mm |
| 31 | NO | 0.90 | 0.89 | — | 0.91 | — | 1–2 | 0.24 | |
| 32 | NO | 1.09 | 1.10 | — | 1.10 | — | 1–2 | 0.16 | $W - W_0 = 200$ mm |
| 33 | NO | 0.98 | 0.90 | — | 0.90 | — | 1–2 | 0.20 | |
| 34 | NO | 1.24 | 1.01 | — | 1.01 | — | 0–1 | 0.02 | slab width - |
| 35 | NO | 1.30 | 1.10 | — | 1.10 | — | 1–2 | 0.21 | 1240 |
| 36 | NO | 1.18 | 0.91 | — | 0.91 | — | 0–2 | 0.18 | |
| 37 | NO | 3.10 | 1.07 | — | 1.09 | — | 1–2 | 0.22 | slab thickness - |
| 38 | NO | 2.94 | 0.89 | — | 0.91 | — | 1–2 | 0.25 | 200 |
| 39 | | | | | | | | | |
| 40 | NO | 4.88 | 0.93 | — | 1.01 | — | 0–1 | 0.06 | compressing |
| 41 | NO | 5.00 | 1.01 | — | 1.10 | — | 1–2 | 0.12 | ratio - |
| 42 | NO | 4.91 | 0.83 | — | 0.92 | — | 1–2 | 0.14 | 1.2-5.0% |
| 43 | NO | 3.51 | 1.03 | — | 1.10 | — | 1–2 | 0.18 | |
| 44 | NO | 3.44 | 0.85 | — | 0.90 | — | 1–2 | 0.16 | |
| 45 | NO | 1.26 | 1.06 | — | 1.09 | — | 1–2 | 0.22 | |
| 46 | NO | 1.11 | 0.88 | — | 0.91 | — | 1–2 | 0.16 | |
| 47 | NO | 2.49 | 0.99 | — | 0.99 | — | 1–2 | 0.02 | slab thickness - |
| 48 | NO | 2.41 | 0.91 | — | 0.91 | — | 0–1 | 0.10 | 50 mm |
| 49 | NO | 2.54 | 1.09 | — | 1.09 | — | 0–2 | 0.13 | |
| 50 | NO | 2.51 | 1.01 | — | 1.03 | — | 0–1 | 0.11 | |
| 51 | NO | 2.53 | 1.07 | — | 1.09 | — | 1–2 | 0.19 | |
| 52 | NO | 2.43 | 0.89 | — | 0.91 | — | 1–2 | 0.22 | |

TABLE 5

Example (reduction taper control)

| Test No. | Steel | Slab width (mm) | Slab thickness (mm) | Holding width ($W_0$) (mm) | Width of unsolidified portion (W) (mm) | Plane reducing width of unsolidified portion ($W-W_0$) (mm) | Deviation from passline (mm) | Plane reducing ratio before action (%) | Reduction taper before action (mm/m) | Suitable plane reducing reaction force ratio |
|---|---|---|---|---|---|---|---|---|---|---|
| Example (invention) | | | | | | | | | | |
| 53 | A | 1820 | 280 | 1620 | 1570 | −50 | 0.1 | 0.9 | 1.0 | 0.85 |
| 54 | A | 1820 | 280 | 1620 | 1570 | −50 | 0.1 | 0.9 | 1.0 | 0.85 |
| 55 | A | 1820 | 280 | 1620 | 1570 | −50 | 0.1 | 0.9 | 1.0 | 0.85 |
| 56 | A | 1820 | 280 | 1620 | 1570 | −50 | 0.3 | 0.9 | 1.0 | 0.85 |
| 57 | A | 1820 | 280 | 1620 | 1570 | −50 | 0.3 | 0.9 | 1.0 | 0.85 |
| 58 | A | 1820 | 280 | 1620 | 1570 | −50 | 0.3 | 0.9 | 1.0 | 0.85 |
| 59 | A | 1820 | 280 | 1620 | 1570 | −50 | 0.5 | 0.9 | 1.0 | 0.85 |
| 60 | A | 1820 | 280 | 1620 | 1570 | −50 | 0.5 | 0.9 | 1.0 | 0.85 |
| 61 | A | 1820 | 280 | 1620 | 1570 | −50 | 0.5 | 0.9 | 1.0 | 0.85 |
| 62 | B | 1820 | 280 | 1620 | 1570 | −50 | 0.1 | 0.9 | 1.0 | 0.90 |

TABLE 5-continued

| Example (reduction taper control) | | | | | | | | | | |
|---|---|---|---|---|---|---|---|---|---|---|
| 63 | B | 1820 | 280 | 1620 | 1570 | −50 | 0.1 | 0.9 | 1.0 | 0.90 |
| 64 | B | 1820 | 280 | 1620 | 1570 | −50 | 0.3 | 0.9 | 1.0 | 0.90 |
| 65 | B | 1820 | 280 | 1620 | 1570 | −50 | 0.3 | 0.9 | 1.0 | 0.90 |
| 66 | B | 1820 | 280 | 1620 | 1570 | −50 | 0.5 | 0.9 | 1.0 | 0.90 |
| 67 | B | 1820 | 280 | 1620 | 1570 | −50 | 0.5 | 0.9 | 1.0 | 0.90 |
| 68 | C | 1820 | 280 | 1620 | 1570 | −50 | 0.1 | 0.9 | 1.0 | 0.95 |
| 69 | C | 1820 | 280 | 1620 | 1570 | −50 | 0.1 | 0.9 | 1.0 | 0.95 |
| 70 | C | 1820 | 280 | 1620 | 1570 | −50 | 0.5 | 0.9 | 1.0 | 0.95 |
| 71 | C | 1820 | 280 | 1620 | 1570 | −50 | 0.5 | 0.9 | 1.0 | 0.95 |
| 72 | A | 1830 | 280 | 1620 | 1590 | −30 | 0.1 | 0.9 | 1.0 | 0.87 |
| 74 | A | 1830 | 280 | 1620 | 1590 | −30 | 0.1 | 0.9 | 1.0 | 0.87 |
| 75 | A | 1830 | 280 | 1620 | 1590 | −30 | 0.3 | 0.9 | 1.0 | 0.87 |
| 76 | A | 1830 | 280 | 1620 | 1590 | −30 | 0.5 | 0.9 | 1.0 | 0.87 |
| 77 | A | 1830 | 280 | 1620 | 1590 | −30 | 0.5 | 0.9 | 1.0 | 0.87 |
| 78 | A | 1870 | 280 | 1620 | 1620 | ±0 | 0.5 | 0.9 | 1.0 | 0.89 |
| 79 | A | 1870 | 280 | 1620 | 1620 | ±0 | 0.1 | 0.9 | 1.0 | 0.89 |
| 80 | A | 1870 | 280 | 1620 | 1620 | ±0 | 0.1 | 0.9 | 1.0 | 0.89 |
| 81 | A | 1870 | 280 | 1620 | 1620 | ±0 | 0.3 | 0.9 | 1.0 | 0.89 |
| 82 | A | 1970 | 280 | 1620 | 1720 | 100 | 0.5 | 0.9 | 1.0 | 0.98 |
| 83 | A | 1970 | 280 | 1620 | 1720 | 100 | 0.5 | 0.9 | 1.0 | 0.98 |
| 84 | A | 2000 | 200 | 1620 | 1820 | 200 | 0.5 | 1.0 | 1.0 | 1.00 |
| 85 | A | 2000 | 200 | 1620 | 1820 | 200 | 0.5 | 1.0 | 1.0 | 1.00 |
| 86 | A | 1210 | 250 | 840 | 990 | 150 | 0.1 | 1.25 | 1.0 | 1.00 |
| 87 | A | 1210 | 250 | 840 | 990 | 150 | 0.3 | 1.25 | 1.0 | 1.00 |
| 88 | A | 1210 | 250 | 840 | 990 | 150 | 0.5 | 1.25 | 1.0 | 1.00 |
| 89 | A | 1700 | 50 | 1620 | 1650 | 30 | 0.1 | 2.5 | 0.5 | 1.00 |
| 90 | A | 1700 | 50 | 1620 | 1650 | 30 | 0.1 | 2.5 | 0.5 | 1.00 |
| 91 | A | 1700 | 50 | 1620 | 1650 | 30 | 0.1 | 2.5 | 0.5 | 1.00 |
| 92 | A | 1820 | 280 | 1620 | 1570 | −50 | 0.1 | 0.9 | 1.0 | 0.85 |
| 93 | A | 1820 | 280 | 1620 | 1570 | −50 | 0.1 | 0.9 | 1.0 | 0.85 |
| 94 | A | 1820 | 280 | 1620 | 1570 | −50 | 0.5 | 0.9 | 1.0 | 0.85 |
| 95 | A | 1820 | 280 | 1620 | 1570 | −50 | 0.5 | 0.9 | 1.0 | 0.85 |
| 96 | A | 1820 | 280 | 1620 | 1570 | −50 | 0.6 | 0.9 | 1.0 | 0.85 |
| 97 | A | 1930 | 280 | 1620 | 1570 | −70 | 0.1 | 0.9 | 1.0 | 0.85 |
| 98 | A | 2600 | 280 | 1620 | 1570 | 210 | 0.1 | 0.9 | 1.0 | 0.85 |
| 99 | A | 1820 | 280 | 1620 | 1570 | −50 | 0.1 | 0.45 | 0.5 | 0.90 |
| 100 | A | 1820 | 280 | 1620 | 1570 | −50 | 0.1 | 5.1 | 5.7 | 0.75 |
| 101 | A | 1820 | 280 | 1620 | 1570 | −50 | 0.1 | 0.9 | 1.0 | 0.85 |
| 102 | A | 1820 | 280 | 1620 | 1570 | −50 | 0.1 | 0.9 | 1.0 | 0.85 |
| 103 | B | 1820 | 280 | 1620 | 1570 | −50 | 0.1 | 0.9 | 1.0 | 0.90 |
| 104 | C | 1820 | 280 | 1620 | 1570 | −50 | 0.2 | 0.9 | 1.0 | 0.95 |

| Test No. | Control | Plane reduction ratio (%) | Actual plane reducing reaction force ratio (before control) | Actual plane reducing reaction force ratio (after control) | Actual reaction force ratio Suitable reaction force ratio (before control) | Actual reaction force ratio Suitable reaction force ratio (after control) | Center segregation index | Center porosity index | Remarks |
|---|---|---|---|---|---|---|---|---|---|
| 53 | YES | 0.85 | 0.75 | 0.86 | 0.88 | 1.01 | 0–1 | 0.02 | |
| 54 | YES | 0.95 | 0.98 | 0.93 | 1.15 | 1.09 | 1–2 | 0.15 | |
| 55 | YES | 0.71 | 0.69 | 0.80 | 0.81 | 0.94 | 0–1 | 0.12 | |
| 56 | YES | 0.76 | 0.72 | 0.83 | 0.85 | 0.98 | 0–1 | 0.06 | |
| 57 | YES | 0.88 | 0.96 | 0.93 | 1.12 | 1.09 | 1–2 | 0.15 | |
| 58 | YES | 0.80 | 0.76 | 0.79 | 0.89 | 0.93 | 1–2 | 0.14 | |
| 59 | YES | 0.82 | 0.75 | 0.81 | 0.88 | 0.95 | 0–2 | 0.06 | |
| 60 | YES | 0.90 | 0.95 | 0.92 | 1.12 | 1.08 | 1–2 | 0.15 | |
| 61 | YES | 0.79 | 0.95 | 0.78 | 1.12 | 0.92 | 1–2 | 0.21 | |
| 62 | YES | 0.94 | 1.02 | 0.98 | 1.11 | 1.09 | 1–2 | 0.14 | |
| 63 | YES | 0.95 | 0.78 | 0.82 | 0.87 | 0.91 | 1–2 | 0.16 | |
| 64 | YES | 0.95 | 1.10 | 0.97 | 1.22 | 1.08 | 1–2 | 0.22 | |
| 65 | YES | 0.71 | 0.80 | 0.83 | 0.89 | 0.92 | 1–2 | 0.19 | |
| 66 | YES | 0.91 | 0.80 | 0.94 | 0.89 | 1.04 | 0–1 | 0.08 | |
| 67 | YES | 0.88 | 0.76 | 0.87 | 0.84 | 0.97 | 0–1 | 0.08 | |
| 68 | YES | 0.77 | 1.10 | 0.86 | 1.16 | 0.91 | 1–2 | 0.15 | |
| 69 | YES | 1.01 | 0.85 | 1.03 | 0.89 | 1.08 | 0–2 | 0.15 | |
| 70 | YES | 0.80 | 1.13 | 0.90 | 1.19 | 0.95 | 1–2 | 0.17 | |
| 71 | YES | 0.99 | 0.82 | 1.03 | 0.86 | 0.08 | 2–2 | 0.21 | |
| 72 | YES | 0.91 | 0.76 | 0.92 | 0.87 | 1.06 | 0–2 | 0.11 | |
| 74 | YES | 0.83 | 0.99 | 0.93 | 1.14 | 1.07 | 0–2 | 0.13 | |
| 75 | YES | 0.86 | 0.98 | 0.90 | 1.13 | 1.03 | 0–2 | 0.10 | |
| 76 | YES | 0.88 | 0.76 | 0.89 | 0.87 | 1.02 | 0–2 | 0.11 | |
| 77 | YES | 0.65 | 0.65 | 0.80 | 0.76 | 0.92 | 1–2 | 0.22 | |
| 78 | YES | 0.54 | 0.60 | 0.81 | 0.67 | 0.91 | 1–2 | 0.15 | |
| 79 | YES | 0.88 | 0.99 | 0.87 | 1.11 | 0.98 | 0–1 | 0.08 | |
| 80 | YES | 0.80 | 0.70 | 0.84 | 0.79 | 0.94 | 1–2 | 0.18 | |
| 81 | YES | 0.54 | 0.65 | 0.81 | 0.73 | 0.91 | 1–2 | 0.20 | |
| 82 | YES | 0.77 | 1.10 | 0.90 | 1.12 | 0.92 | 1–2 | 0.20 | |
| 83 | YES | 0.92 | 0.86 | 1.02 | 0.88 | 1.04 | 0–2 | 0.09 | |
| 84 | YES | 0.98 | 0.81 | 1.01 | 0.81 | 1.01 | 0–1 | 0.09 | |
| 85 | YES | 0.87 | 0.64 | 0.90 | 0.64 | 0.90 | 1–2 | 0.22 | |
| 86 | YES | 1.02 | 0.88 | 1.02 | 0.88 | 1.02 | 0–1 | 0.06 | |

TABLE 5-continued

| Example (reduction taper control) | | | | | | | | |
|---|---|---|---|---|---|---|---|---|
| 87 | YES | 0.85 | 0.85 | 0.90 | 0.85 | 0.90 | 1-2 | 0.13 |
| 88 | YES | 0.99 | 0.88 | 0.99 | 0.88 | 0.99 | 0-2 | 0.16 |
| 89 | YES | 2.40 | 0.76 | 1.01 | 0.76 | 1.01 | 0-1 | 0.03 |
| 90 | YES | 1.80 | 1.21 | 0.90 | 1.21 | 0.90 | 1-2 | 0.19 |
| 91 | YES | 3.50 | 0.84 | 1.10 | 0.84 | 1.10 | 1-2 | 0.23 |
| 92 | NO | — | 0.76 | — | 0.89 | — | 1-5 | 0.54 |
| 93 | NO | — | 0.94 | — | 1.11 | — | 2-5 | 0.61 |
| 94 | NO | — | 0.75 | — | 0.88 | — | 0-6 | 0.77 |
| 95 | NO | — | 0.95 | — | 1.12 | — | 1-4 | 0.44 |
| 96 | NO | — | 0.86 | — | 1.01 | — | 1-6 | 1.01 |
| 97 | NO | — | 0.84 | — | 0.99 | — | 1-5 | 0.98 |
| 98 | NO | — | 0.85 | — | 1.00 | — | 1-4 | 1.16 |
| 99 | NO | — | 0.89 | — | 0.99 | — | 2-6 | 2.14 |
| 100 | NO | — | 0.76 | — | 1.01 | — | 1-5 | 0.62 |
| 101 | YES | 0.80 | 0.57 | 0.76 | 0.67 | 0.89 | 1-6 | 1.39 |
| 102 | YES | 0.95 | 0.67 | 0.95 | 0.79 | 1.11 | 1-4 | 2.40 |
| 103 | YES | 1.00 | 0.90 | 1.08 | 1.00 | 1.35 | 2-6 | 3.52 |
| 104 | YES | 0.80 | 0.74 | 0.85 | 0.78 | 0.89 | 1-5 | 2.43 |

The operating conditions and some definitions are explained below:

(1) Method for Detecting Width of Unsolidified Portion at solidified End Portion of Strand Slab Use is made of calculations by a general heat balance equation based on the molten steel temperature, the molten steel casting temperature, the drawing speed, and the cooling rate or use is made of an ultrasonic measuring apparatus.

(2) Method for Detecting Compressing Reaction Force

The reaction force is detected by inserting a pressure block of a load cell between the bearing and the vertical frame.

(3) Center Porosity Index

The index is determined by the following equation index $$\frac{G_o - G}{G_o} \times 100\%$$

wherein, $G_o$ is the specific gravity of a portion 3 to 10 mm from the surface of the strand slab.

G is the apparent specific gravity of a portion of center segregation ±3.5 mm (7 mm thickness)

When the index is 0.3 or less, the center porosity is harmless. When it is more than 0.3, the compressing treatment is effected.

(4) Standard Reduction Taper of Unsolidified End Portion of Strand Slabs

The taper measured and controlled by means of scales (17, 18) provided at predetermined positions between representative upper and lower bars of the inner and outer sets.

(5) Center Segregation Index

TABLE 7

| Segregation index | Thickness of segregation band | Level in use |
|---|---|---|
| 0 | 0.0-0.2 mm | Usable for required use as cast. |
| 1 | 0.2-0.4 mm | Omittable in the segregation diffusion |
| 2 | 0.4-0.6 mm | treatment (Steel having severity in segregation can be produced at low cost) |
| 3 | 0.6-0.8 mm | Usable for a desired use after diffusing |
| 4 | 0.8-1.0 mm | segregation (diffusion treatment) |
| 5 | 1.0-1.5 mm | Even if the diffusion treatment is |
| 6 | 1.5-2.0 mm | effected, unusable for steel having |
| 7 | 2.0- mm | severity in segregation. |

TABLE 7-continued

| Segregation index | Thickness of segregation band | Level in use |
|---|---|---|
| | | Usable the other use or scrapped. |

(6) Control of Compression with of Walking Bar

Figure 13:
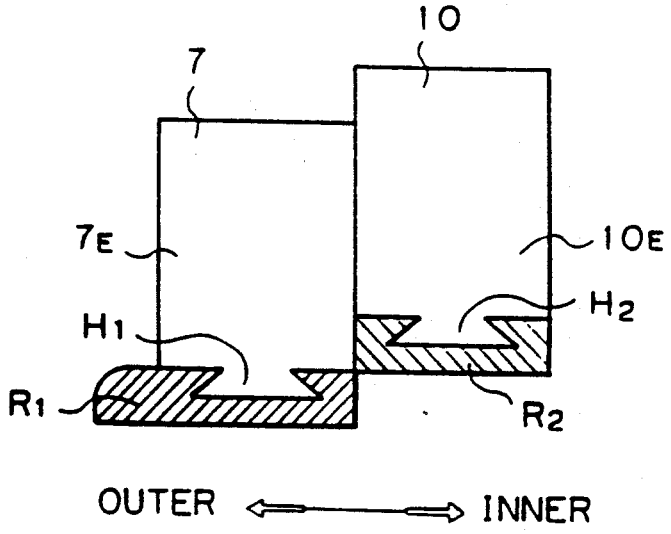
FIG. 13 is a partial view explaining compression width of the walking bars.

The control of the compression width of the walking bar is carried out as shown by FIG. 13, by providing a pigeon tail-shaped connecting portions $H_1$ and $H_2$ at both ends 7E and 10E of each outer bar 7 and outer bar 10, forming slidable liner $R_1$ and $R_2$ thereat, and setting the compression width by a replacement of the liner width or (7) Control Flow (a) Set up

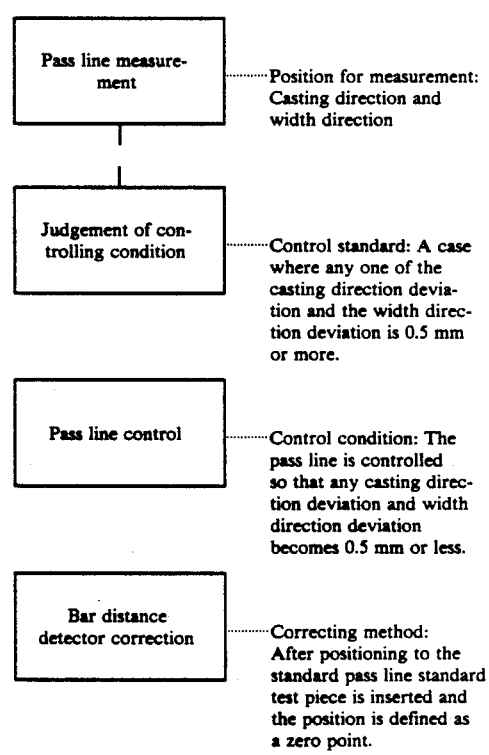

-continued

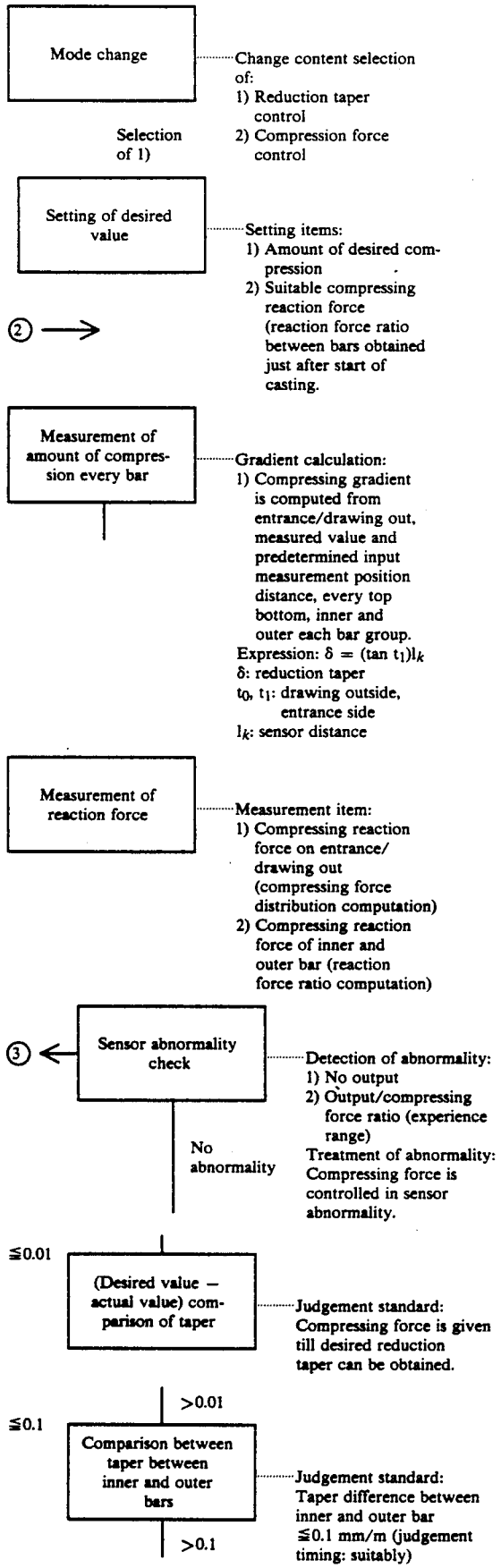

-continued

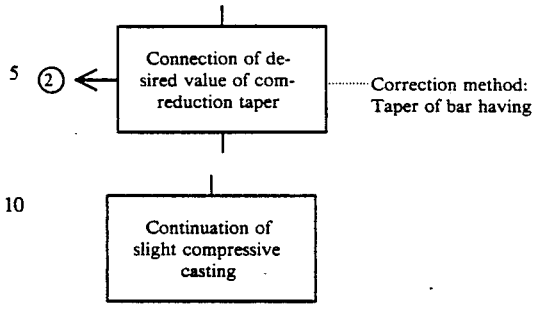

(8) Holding and Carrying Apparatus

Figure 7:
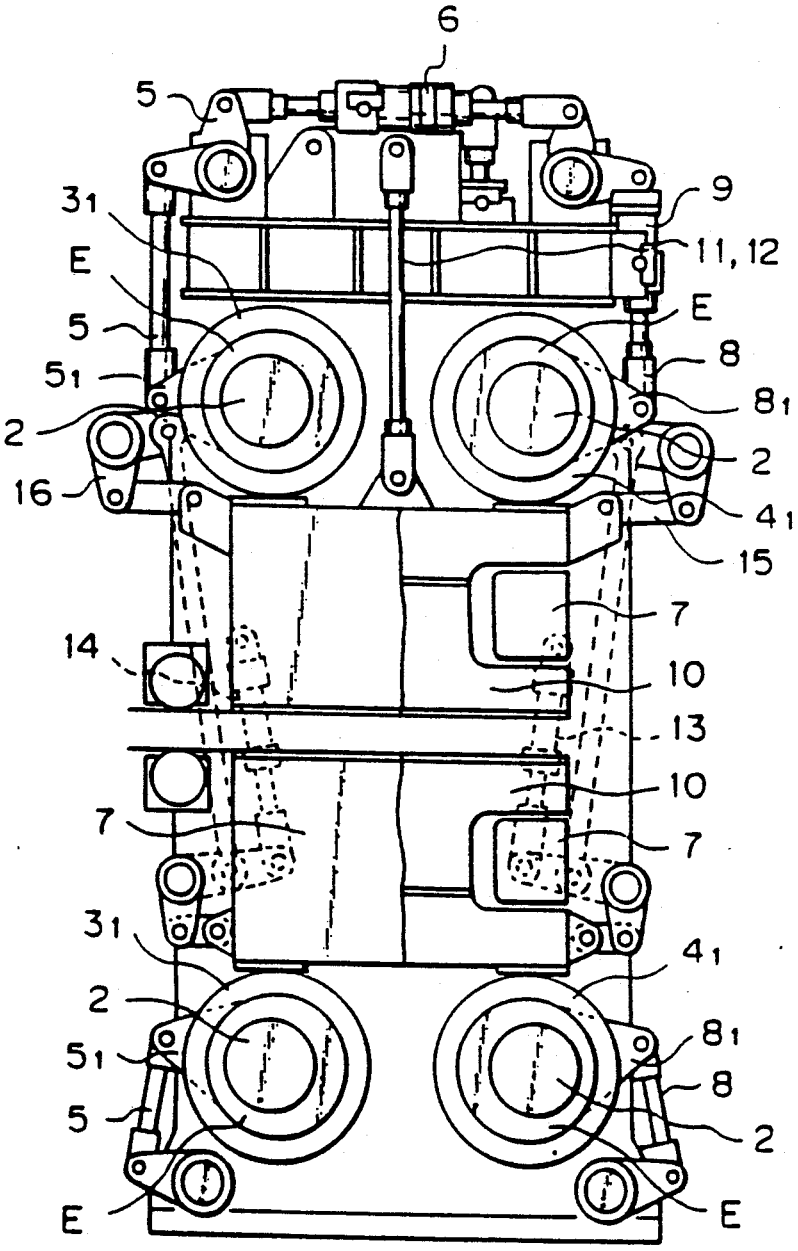
FIGS. 7 to 11 illustrate a slab reducing means including walking bars according to the present invention. Particularly.
Figure 8:
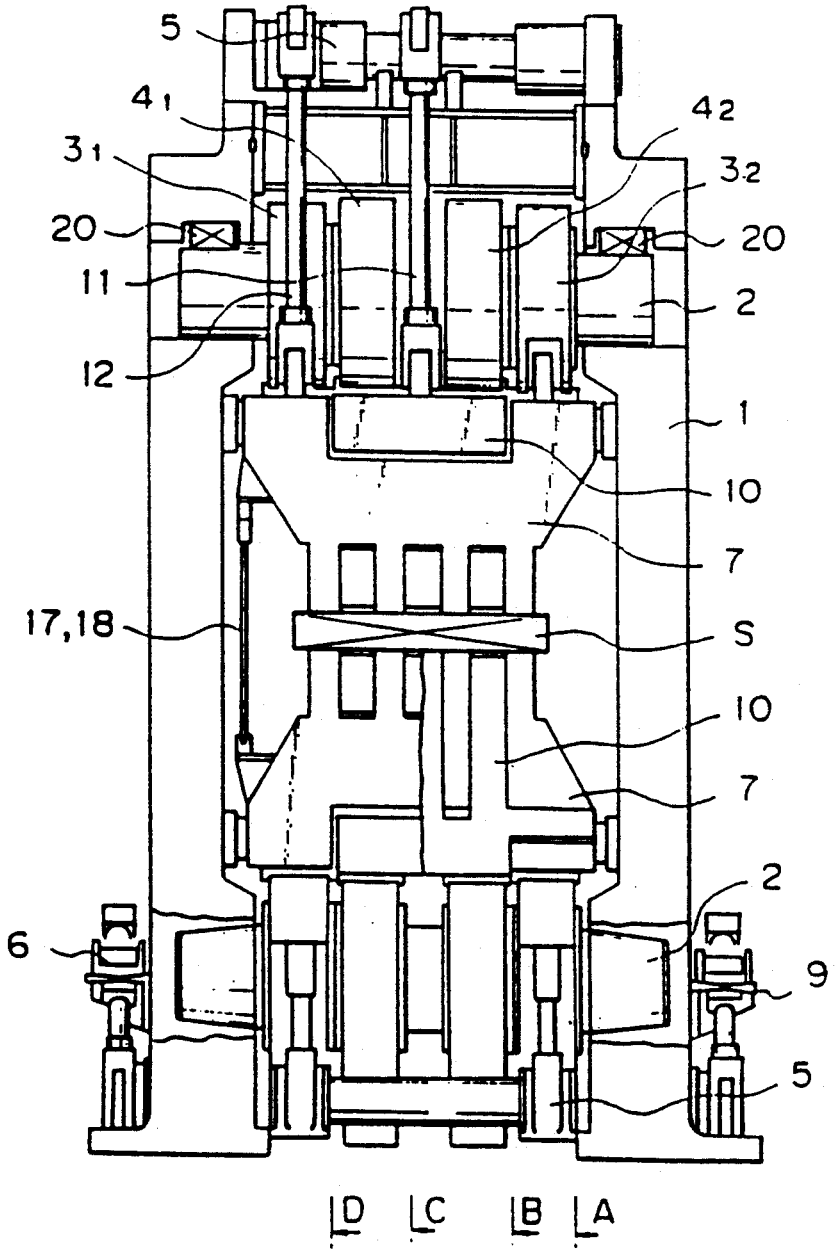
Figure 9:
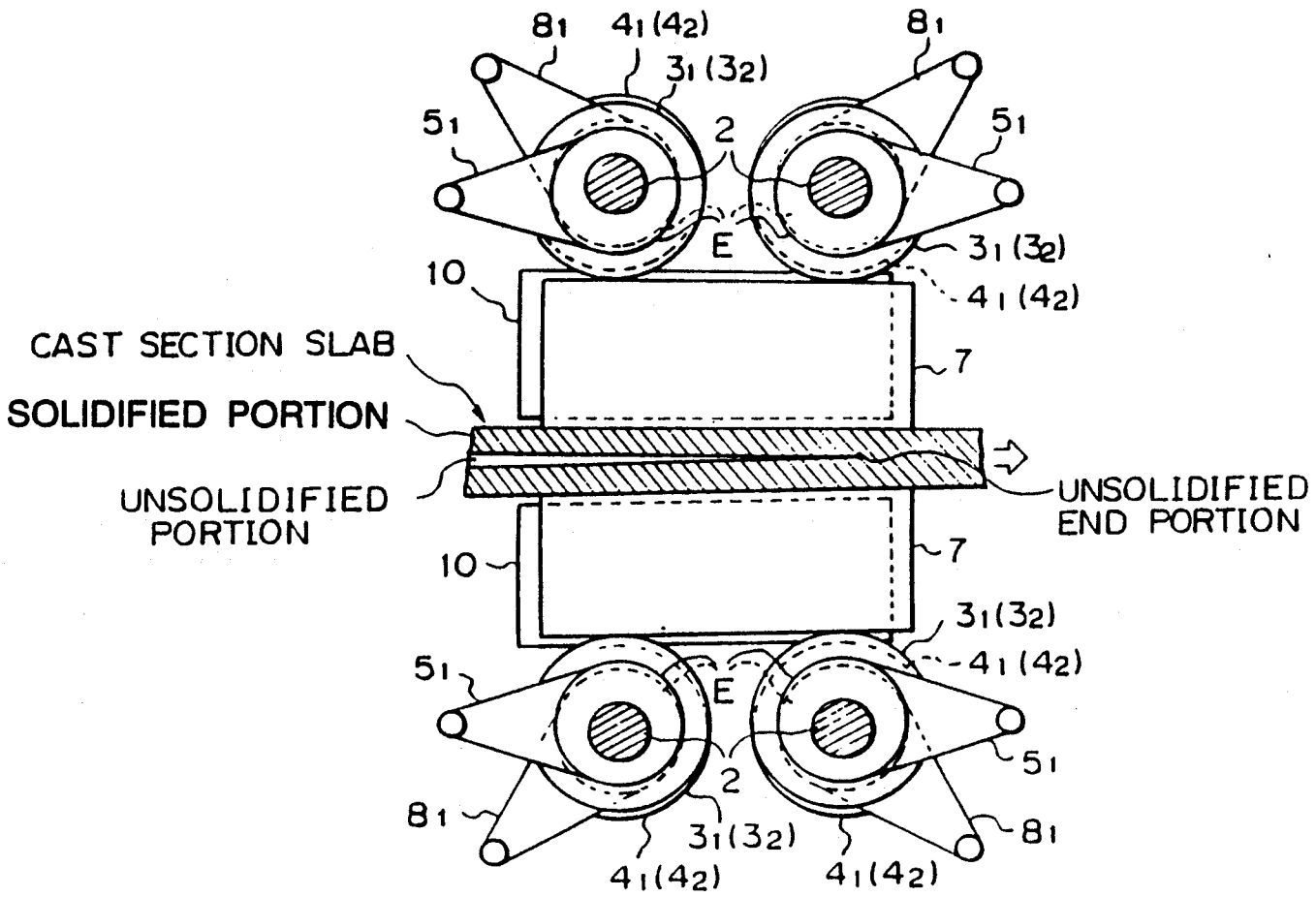
Figure 10:
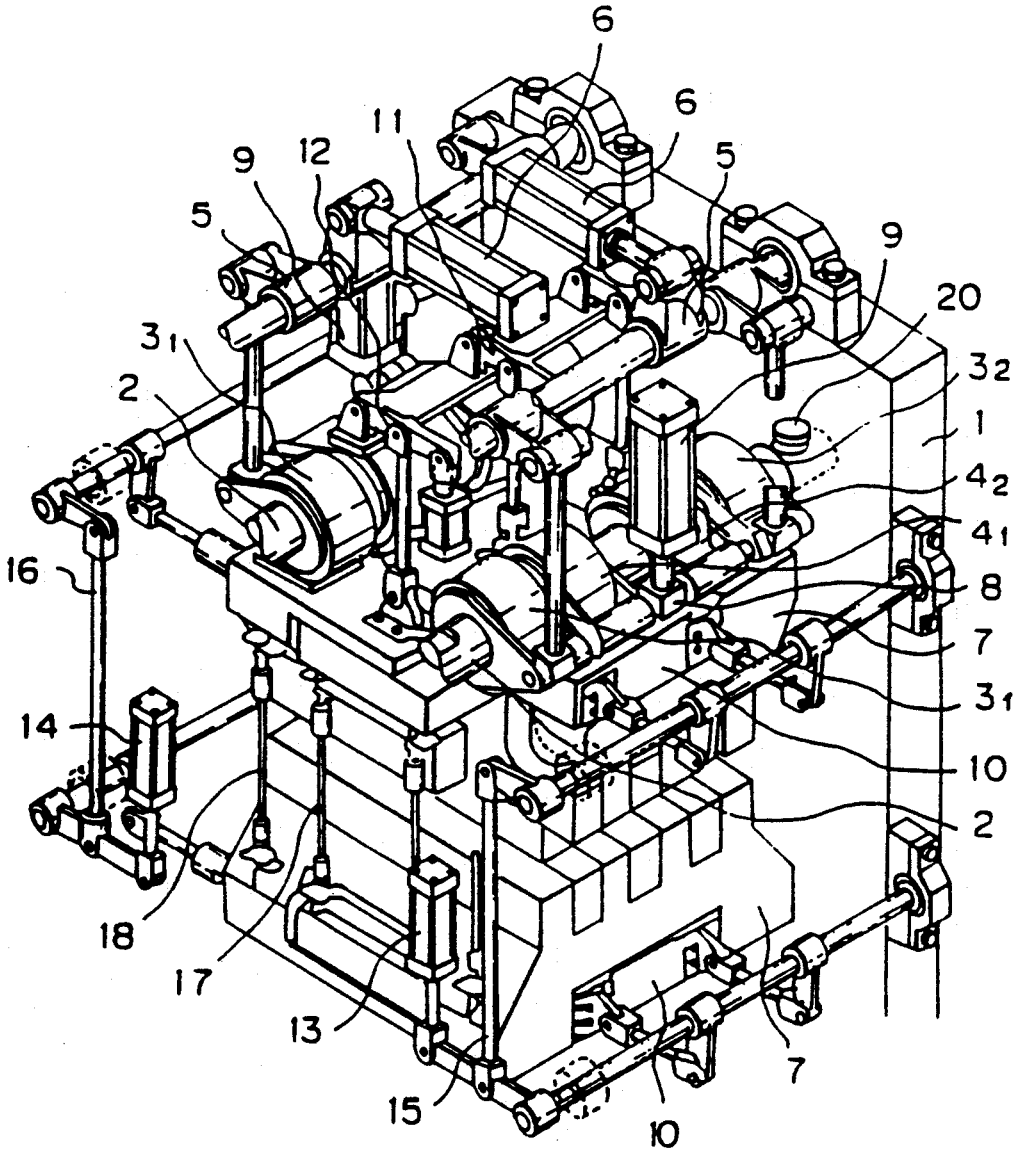
Figure 11:
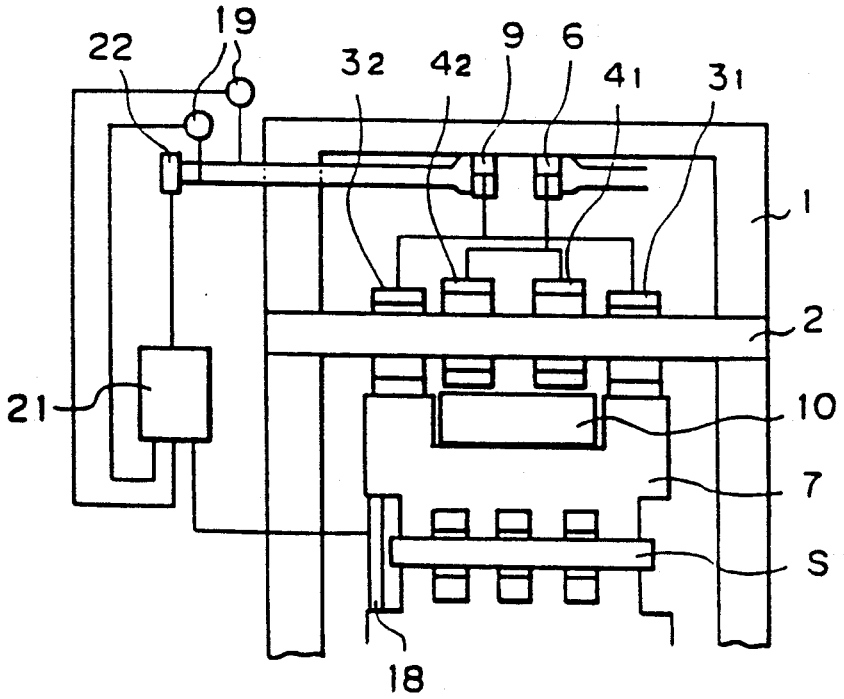
Figure 12:
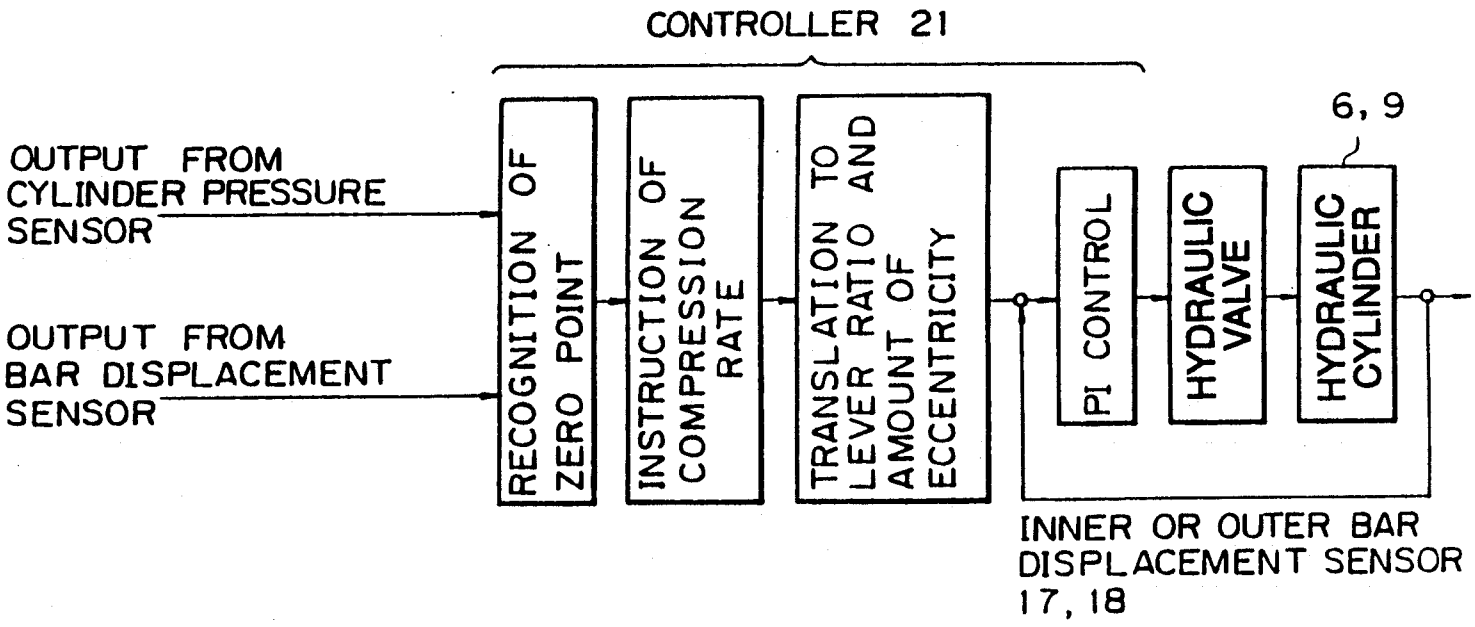
FIG. 12 is a block diagram of the control device.

FIGS. 7 to 12 show a preferred embodiment of the apparatus. FIG. 7 is a side elevation, FIG. 8 is a front view, FIG. 9 is an A–D cross-sectional view showing motions of an wheeled bearing and an eccentric cam while compressing a cast section slab by inner and outer bars, FIG. 10 is a perspective view, FIG. 11 is a view of the control system, and FIG. 12 is a block diagram. The holding and carrying apparatus shown is used in an area where the continuous cast strand is guided horizontally.

In these drawings, 1 is a vertical frame, 2 are supporting shafts axially fixed in the width direction at the front and back at the top portion of the vertical frame 1, $3_1$, $3_2$ are wheeled bearings rotatably attached to the periphery of the eccentric cams for the outer walking bar, $4_1$ $4_2$ are wheeled bearings rotatably attached to the periphery of eccentric cams for the inner walking bar, 5 is a link, mechanism for compressing the outer walking bar, 6 is a hydraulic cylinder for compressing the outer walking bar 7 is an outer walking bar, 8 is a link mechanism for compressing the inner walking bar, 9 is a hydraulic cylinder for compressing the inner walking bar, 10 is an inner walking bar, 11 is an apparatus for lifting the inner bar, 12 is an apparatus for lifting the outer bar, 13 is a hydraulic cylinder for making the inner bar (approach, return) reciprocate, 14 is a hydraulic cylinder for making the outer bar reciprocate, 15 is a link mechanism for making the inner bar reciprocate, 16 is a link mechanism for making the outer bar reciprocate, 17 is a displacement sensor for the inner bar, 18 is a displacement sensor for the outer bar, 19 is a pressure gauge, 20 is a load cell, 21 is a controller, and 22 is a servo valve.

The basic feature of the apparatus resides in the fact that the vertical frame 1 is provided with two upper and two lower supporting shafts (total four). The compressing force on the stand S is looped between each two supporting shafts to form an inner force. The weight of the apparatus is basically force by the base. Further, the supporting shaft 2 has four bearings with eccentric cams E and wheels, in which two outside bearings $3_1$ and $3_2$ are used for the outer bar and two inside bearings $4_1$ and $4_2$ are used for the inner bar.

These bearings $3_1$, $3_2$, $4_1$ and $4_2$ can be moved upward and downward by rotating the eccentric cams E by using the hydraulic cylinders 6 and 9.

The wheeled bearings $3_1$ and $3_2$ for the outer bar are constructed so that the outer bar 7 is moved and downward by operating the eccentric cams using the hydraulic cylinder 6 for compressing the outer bar, via the link mechanism 5 for compressing the outer bar, and via the link $5_1$ for compressing the outer bar. By the upward and downward motion, force is transmitted to the strand S through the outer bar 7.

Further, the apparatus is constructed so that, alternately with the provision force through the outer bar, the wheeled bearings $4_1$ and $4_2$ for the inner bar are moved upward and downward by rotating the eccentric cams E to a desired angle using the hydraulic cylinder 9 for compressing the inner bar, through the link mechanism 8 for compressing the inner bar, and the link 8, for compressing the inner bar, whereby the inner bar 10 is moved upward and downward so that force is transmitted to the stand S.

FIG. 9 is a cross-sectional view showing the operating states of the eccentric cams E and the bearings $3_1$, $3_2$, $4_1$ and $4_2$ during the compressing of the outer bars 7 and return of the inner bars 10.

Further, the compressive contact of the bearings with the inner bars 10 and the outer bars 7 is maintained by the weight of the bars at the lower side thereof. Both the inner bars 10 and the outer bars 9 are lifted by a lifting apparatus, whereby the release motion from the strand S can be achieved.

Further, for the approach run and return of the inner bars 10 and outer bars 7; a hydraulic cylinder 13 for inner bar approach run and return and a hydraulic cylinder 14 for outer bar approach run and return are provided. The upper and lower inner bars 10 and outer bars 7 are mechanically synchronized with each other to carry out the approach run and return through the link mechanisms 15 and 16. The inner bars 10 and the outer bars 7 of this example perform the compression in an overlapped pattern, as shown in FIG. 14.

To be concrete, the inner bars 10 actuate the inner bar compressing hydraulic cylinder 9 for holding while the outer bars 10 are compressing the cast strand S, thereby lowering the inner bars 10 through the inner bar compressing link mechanism 86 as described previously. At the same time, the inner bar reciprocating the (approach run and return) hydraulic cylinder 13 is actuated to move the inner bars 10 at substantially the same speed as the casting speed so that no excessive force is exerted on the cast strand S in holding. By the action of the inner bar reciprocating hydraulic cylinder 13 the inner bars 10 at the top and bottom re simultaneously accelerated through the inner bar reciprocating link mechanism 15. The inner bars 10 are accelerated to a given speed by the time when holding is effected. The acceleration is completed when holding is performed. On completion of holding, the inner bars 10 move forward while holding the cast strand S to the point of releasing, keeping pace with the travel speed of the strand.

The outer bars 7 release the cast strand S after it has been held by the inner bars 10. The release of the cast strand S is effected through the outer bar compressing link mechanism 5 and a compressing link 5, by extracting the hydraulic fluid from the outer walking-bar compressing hydraulic cylinder 6.

When the outer bars 7 are away from the cast strand S by a given distance, the outer bar reciprocating hydraulic cylinder 14 is actuated to return the outer bars 7 to a predetermined position through the outer bar reciprocating link mechanism 16. Then, the holding process of the outer-bars begins. This process is performed in the same manner as the holding by the inner bars. Namely, the outer bar compressing hydraulic cylinder 65 is actuated to respectively move down and up the outer bars 7 at the top and bottom through the outer bar compressing link mechanism 5 and the outer bar compressing link 5. At the same time, the outer bar reciprocating hydraulic cylinder 14 is actuated to accelerate the outer bars 7 to a given speed through the outer bar reciprocating link mechanism 15.

The release and return of the inner bars 10 are also performed in the same manner as those of the outer bars 76. Namely, the hydraulic fluid is extracted from the inner bar compressing hydraulic cylinder 96 to cause the inner bars 10 to release the cast strand S through the inner bar compressing link mechanism 8 and the inner bar compressing link 8. When the inner bars 10 are away from the cast strand S by a given distance, the inner bar reciprocating hydraulic cylinder 13 is actuated to return the inner bars 10 to a predetermined position through the inner bar reciprocating link mechanism 15, where they begin to carry out the next approach run operation.

After the cast strand S has been chucked by the inner bars 10, or the outer bars 7.

The point at which the pressure gauge 19 senses the pressure corresponding to the bulging force is made the zero point. Subsequent displacement is measured by the inner bar displacement sensor 17 or the outer bar displacement sensor 18. Oil is supplied into the inner bar compression hydraulic cylinder 9 or the outer bar compression hydraulic cylinder 6 through a controller 21. The amount of compression is controlled by actuating the cylinders 9 and 6 so that a given amount of compression force is applied on the strand S. FIG. 12 is a block diagram of the operations.

As apparent from Tables 2 and 5, the cast strands obtained from the examples of the present invention were improved very much in the center segregation and the center porosity at both the strand width center portion and the width side edge portion. Further, the improvement was uniformly realized in the strand width direction. In the use of steel material produced from the cast strand, severe conditions of use could be satisfied.

Thus, the productivity and economicalness of high quality thick steel sheet such as anti-sour gas line pipe steel or anti-lamellar tear steel were remarkably improved.

On the other hand, in the comparative examples, non-uniform generation of center segregation and center porosity could be found at the strand center portions in the width direction and the side edge portions therein. This is disadvantageous in the severe use of above-mentioned steel.

These cast strands were rolled and studied as to the mechanical properties and chemical properties of the resultant steel sheet. Relief treatment was applied in accordance with the results.

Some slabs of the comparative examples were subjected to a high temperature heating segregation diffusion treatment and/or contact pressing, whereby the conditions for the desired use could be satisfied. However, the production cost of the steel was increased. The other slabs could not be used to make steel materials amendable to relief treatment.

We claim:

1. In a method for improving internal center segregation and center porosity of a continuously cast slab cast from a continuous casting machine having a passline, wherein a plane reducing zone is defined from a solidified portion downstream from an unsolidified end portion of said slab to a selected slab portion upstream from said unsolidified end portion during continuous casting of said slab, said method comprising:

providing a slab reducing means for said slab at said plane reducing zone, said slab reducing means having:

a group of top and a group of bottom walking bars, each group of walking bars composed of a set of outer bars and a set of inner bars disposed between the outer bars defining a walking plane reducing means, the slab reducing means carrying out an upward and downward movement of the inner and outer walking bars of each set of walking bars to hold, reduce, and release said slab, said slab reducing means comprising front and rear support shafts common to said sets, eccentric cams for each set arranged on said support shafts, wheel bearings arranged about said eccentric cam, and a rotating mechanism means for rotating said eccentric cams, said slab reducing means including forward direction and rearward direction displacement mechanism means for forward and rearward displacement of said sets of top and bottom walking bars, each of said inner and outer bottom walking bars having an upper surface for holding said cast slab, said upper surfaces of a respective set of bottom walking bars being positioned within 0.5 mm deviation from said continuous casting machine passline when said cast slab is being reduced and held by said set of said bars, each set of said inner and outer top walking bars having a lower surface for holding said cast slab, said lower surfaces of said top walking bars being set at a selected predetermined reduction taper obtained by the amount of solidified shrinkage of the unsolidified slab and heat shrinkage of the solidified shell in the plane reducing zone, said reduction taper being within a plane reduction ratio of 0.5 to 5.0% when said reduction taper is converted into plane reduction ratio, wherein said slab reducing means including said forward direction and rearward direction displacement mechanism means operates to hold, move forward, release, and move rearward each set of said inner and outer walking bars set to thereby alternately compressively carry the cast slab, the improvement comprising:

measuring for each of the two opposed sets of walking bars after the start of holding and before release holding distances $D_1$ and $D_2$ on the slab for the top and bottom walking bars, $D_1$ and $D_2$ corresponding to the thickness of the slab at a spaced apart longitudinal distance D, and obtaining the reduction taper of said top walking bars by the formula:

$$(D_1-D_2)/D$$

comparing the differences between the reduction tapers of each set of top of walking bars, wherein when the difference between the reduction tapers is 0.1 mm/m or less, each of said top walking bars is reduced by said slab reducing means to obtain the predetermined reduction taper after obtaining differences between the measured reduction tapers and the predetermined reduction taper, and wherein when difference between the reduction tapers is more than 0.1 mm/m and each of said reduction tapers of the top walking bars is less than said predetermined reduction taper, the top walking bars having a smaller different distance from the predetermined reduction taper is positioned by said slab reducing means to obtain the reduction taper of the other top walking bars, after agreement of the reduction tapers of both inner and outer top walking bars, both the inner and outer top walking bars are reduced by said slab reducing means to the predetermined reduction taper.

2. A method according to claim 5, wherein plane reduction is carried out while maintaining the following relationship between the maximum compressive holding width $W_0$ of the walking plane reducing means in a width direction of the cast strand at the upstream edge (the walking plane reducing means entrance side) in said plane reducing zone and the unsolidified end portion width W of the cast slab;

$$-60\text{ mm} \leqq W-W_0 \leqq 200\text{ mm}.$$

3. In a method of improving internal center segregation and center porosity of a continuously cast slab cast from a continuous casting machine having a passline, wherein a plane reducing zone is defined from a solidified portion downstream from an unsolidified end portion of said slab to a selected slab portion upstream from said unsolidified end portion during a continuous casting of said slab, said method comprising:

providing a slab reducing means for said slab at said plane reducing zone, said slab reducing means having:

a group of top and a group of bottom walking bars, each group of walking bars composed of a set of outer bars and a set of inner bars disposed between the outer bars defining a walking plane reducing means, the slab reducing means carrying out an upward and downward movement of the inner and outer walking bars of each set of walking bars to hold, reduce, and release said slab, said slab reducing means comprising front and rear support shafts common to said sets at front and rear ends of said sets, eccentric cams for each set arranged on said support shafts, wheel bearings arranged about said eccentric cams, and a rotating mechanism means for rotating said eccentric cams, said slab reducing means including forward direction and rearward direction displacement mechanism means for forward and rearward displacement of said sets of top and bottom walking bars, each of said inner and outer bottom walking bars having an upper surface for holding said cast slab, said upper surfaces of a respective set of bottom walking bars being positioned within 0.5 mm deviation from said continuous casting machine passline when said cast slab is being reduced and held by said set of said bars, each of said inner and outer top walking bars having a lower surface for holding said cast slab, said lower surfaces of said top walking bars being set at a selected predetermined reduction taper obtained by the amount of solidified shrinkage of the unsolidified slab and heat shrinkage of the solidified shell in the plane reducing zone, said reduction taper being within a plane reduction ratio of 0.5 to 5.0% when said reduction taper is converted into plane reduction ratio, wherein said slab reducing means including said forward direction and rearward direction displacement mechanism means operates to hold, move forward, release, and move rearward each set of said inner and outer walking bars to thereby alternately compressively carry the cast slab, the improvement comprising:

measuring plane reaction force at the front end and rear end of each set of top and bottom walking bars caused by holding of the cast slab by the walking bars at a selected rotary angle of the eccentric cams and obtaining a first ratio between the measured values of the plane reducing reaction forces at the front end and rear end of each inner set and outer set of the walking bars, obtaining a second ratio from the measured first ratio and a desired predetermined ratio of the plane reducing reaction forces of each set of the walking bars, controlling the plane reducing reaction forces while holding the cast slab by said slab reducing means so that said second ratio is from 0.9 to 1.1.

4. A method according to claim 3, wherein plane reduction is carried out while maintaining the following relationship between the maximum compressive holding width $W_0$ of a plane reducing means in a width direction of the cast strand at the upstream edge (the walking plane reducing means entrance side) in said plane reducing zone and the unsolidified end portion width W of the cast slab:

$$-60 \text{ mm} \leqq W - W_0 \leqq 200 \text{ mm}.$$

* * * * *

UNITED STATES PATENT AND TRADEMARK OFFICE

CERTIFICATE OF CORRECTION

PATENT NO. : 5,083,604

DATED : January 28, 1992

INVENTOR(S) : Masafumi ZEZE, et al.

It is certified that error appears in the above-identified patent and that said Letters Patent is hereby corrected as shown below:

Column 28, line 8, change "claim 5" to --claim 1--.

Signed and Sealed this

Seventeenth Day of August, 1993

Bruce Lehman

*Attest:*

BRUCE LEHMAN

*Attesting Officer*

*Commissioner of Patents and Trademarks*